US009988855B2

(12) United States Patent
Logan et al.

(10) Patent No.: US 9,988,855 B2
(45) Date of Patent: Jun. 5, 2018

(54) METHODS AND APPARATUS FOR GENERATING ELECTROMAGNETIC TELEMETRY SIGNALS

(71) Applicant: EVOLUTION ENGINEERING INC., Calgary (CA)

(72) Inventors: Aaron W. Logan, Calgary (CA); Daniel W. Ahmoye, Calgary (CA); David A. Switzer, Calgary (CA); Justin C. Logan, Calgary (CA); Patrick R. Derkacz, Calgary (CA); Mojtaba Kazemi Miraki, Calgary (CA)

(73) Assignee: Evolution Engineering Inc., Calgary (CA)

( * ) Notice: Subject to any disclaimer, the term of this patent is extended or adjusted under 35 U.S.C. 154(b) by 0 days. days.

(21) Appl. No.: 15/586,161

(22) Filed: May 3, 2017

(65) Prior Publication Data

US 2017/0247952 A1 Aug. 31, 2017

Related U.S. Application Data

(63) Continuation of application No. 14/900,063, filed as application No. PCT/CA2014/050590 on Jun. 20, 2014, now Pat. No. 9,670,771.

(60) Provisional application No. 61/838,196, filed on Jun. 21, 2013.

(51) Int. Cl.

| | |
|---|---|
| ***E21B 17/00*** | (2006.01) |
| ***E21B 47/12*** | (2012.01) |
| ***E21B 17/02*** | (2006.01) |

(52) U.S. Cl.
CPC ..... *E21B 17/006* (2013.01); *E21B 17/003* (2013.01); *E21B 17/028* (2013.01); *E21B 47/122* (2013.01)

(58) Field of Classification Search
CPC .... E21B 17/003; E21B 17/006; E21B 17/028; E21B 47/122
See application file for complete search history.

(56) References Cited

U.S. PATENT DOCUMENTS

| | | | |
|---|---|---|---|
| 3,061,728 | A | 10/1962 | Arnold |
| 5,883,516 | A | 3/1999 | Van Steenwyk et al. |
| 6,188,223 | B1 | 2/2001 | Van Steenwyk et al. |
| 6,396,276 | B1 | 5/2002 | Van Steenwyk et al. |
| 7,252,160 | B2 | 8/2007 | Dopf et al. |
| 7,255,183 | B2 | 8/2007 | Cramer |
| 7,605,716 | B2 | 10/2009 | Peter et al. |
| 7,782,060 | B2 | 8/2010 | Clark et al. |

(Continued)

FOREIGN PATENT DOCUMENTS

| | | | |
|---|---|---|---|
| GB | 2399961 | A | 9/2004 |
| GB | 2404401 | A | 2/2005 |

(Continued)

*Primary Examiner* — Leon Flores
(74) *Attorney, Agent, or Firm* — Oyen Wiggs Green & Mutala LLP

(57) ABSTRACT

An electromagnetic telemetry signal generating assembly comprises a first section of drill string, a second section of drill string, a gap sub configured to insulate the first section from the second section, and a power source configured to provide a first voltage to a control circuit. The control circuit is configured to drive a second voltage between the sections of drill string. The gap sub provides a gap of at least 12 inches (30 cm). The second voltage may be different than the first voltage.

20 Claims, 28 Drawing Sheets

(56) References Cited

U.S. PATENT DOCUMENTS

| | | | |
|---|---|---|---|
| 8,648,733 | B2 | 2/2014 | Dopf et al. |
| 2007/0247328 | A1 | 10/2007 | Petrovic et al. |
| 2008/0060846 | A1 | 3/2008 | Belcher et al. |
| 2011/0309949 | A1 | 12/2011 | Dopf et al. |
| 2013/0043874 | A1 | 2/2013 | Clark et al. |
| 2014/0083773 | A1 | 3/2014 | Minosyan et al. |
| 2014/0231139 | A1 | 8/2014 | Rozenblit et al. |

FOREIGN PATENT DOCUMENTS

| | | | |
|---|---|---|---|
| GB | 2462757 | A | 7/2010 |
| WO | 2010121345 | A1 | 10/2010 |

METHODS AND APPARATUS FOR GENERATING ELECTROMAGNETIC TELEMETRY SIGNALS

CROSS-REFERENCE TO RELATED APPLICATIONS

This application is a continuation of U.S. application Ser. No. 14/900,063, which is a 371 of PCT International Application No. PCT/CA2014/050590 filed 20 Jun. 2014, which claims the benefit under 35 U.S.C. § 119 of U.S. Application No. 61/838,196 filed 21 Jun. 2013 and entitled METHODS AND APPARATUS FOR GENERATING ELECTROMAGNETIC TELEMETRY SIGNALS, all of which are hereby incorporated herein by reference for all purposes.

FIELD

This disclosure relates generally to gap sub assemblies and electrically-insulating collars for gap sub assemblies. Embodiments provide gap sub assemblies that provide high levels of insulation between portions of drill string, thereby enabling electromagnetic telemetry to be performed with high efficiency (i.e. high signal strength relative to the power used to generate the signal).

BACKGROUND

The recovery of hydrocarbons from subterranean zones relies on the process of drilling wellbores. This process includes drilling equipment situated at the surface and a drill string extending from the surface equipment to the formation or subterranean zone of interest. The drill string can extend thousands of feet or meters below the surface. The terminal end of the drill string includes a drill bit for drilling, or extending, the wellbore. The process also relies on some sort of drilling fluid system, in most cases a drilling "mud". The mud is pumped through the inside of the drill string, which cools and lubricates the drill bit and then exits out of the drill bit and carries rock cuttings back to surface. The mud also helps control bottom hole pressure and prevents hydrocarbon influx from the formation into the wellbore and potential blow out at the surface.

Directional drilling is the process of steering a well from vertical to intersect a target endpoint or to follow a prescribed path. At the terminal end of the drill string is a bottom hole assembly (BHA) which may include 1) the drill bit; 2) a steerable downhole mud motor of a rotary steerable system; 3) sensors of survey equipment for logging while drilling (LWD) and/or measurement while drilling (MWD) to evaluate downhole conditions as drilling progresses; 4) apparatus for telemetry of data to the surface; and 5) other control equipment such as stabilizers or heavy weight drill collars. The BHA is conveyed into the wellbore by a string of metallic tubulars known as the drill string. MWD equipment may be used to provide downhole sensor and status information at the surface while drilling in a near real-time mode. This information is used by the rig crew to make decisions about controlling and steering the well to optimize the drilling speed and trajectory based on numerous factors, including lease boundaries, existing wells, formation properties, hydrocarbon size and location. These decisions can include making intentional deviations from the planned wellbore path as necessary, based on the information gathered from the downhole sensors during the drilling process. In its ability to obtain real time data, MWD allows for a relatively more economical and efficient drilling operation.

Various telemetry methods may be used to send data from MWD or LWD sensors back to the surface. Such telemetry methods include, but are not limited to, the use of hardwired drill pipe, acoustic telemetry, use of fibre optic cable, mud pulse (MP) telemetry and electromagnetic (EM) telemetry.

EM telemetry involves the generation of electromagnetic waves at the wellbore which travel through the earth's surrounding formations and are detected at the surface.

Advantages of EM telemetry relative to MP telemetry, include generally faster baud rates, increased reliability due to no moving downhole parts, high resistance to lost circulating material (LCM) use, and suitability for air/underbalanced drilling. An EM system can transmit data without a continuous fluid column; hence it is useful when there is no mud flowing. This is advantageous when the drill crew is adding a new section of drill pipe as the EM signal can transmit the directional survey while the drill crew is adding the new pipe.

Disadvantages of EM telemetry include lower depth capability, incompatibility with some formations (for example, high salt formations and formations of high resistivity contrast), and some market resistance due to acceptance of older established methods. Also, as EM transmission is strongly attenuated over long distances through the earth formations, it requires a relatively large amount of power so that the signals are detected at surface. Higher frequency signals attenuate faster than low frequency signals.

A BHA metallic tubular is generally used as the dipole antennae for an EM telemetry tool by dividing the drill string into two conductive sections by an insulating joint or connector which is known in the art as a "gap sub". A voltage is driven between the two conductive sections to produce an electromagnetic signal.

A gap sub must withstand the mechanical loading induced during drilling and the high differential pressures that occur between the center and exterior of the drill pipe. These mechanical loads are typically quite high and most drill string components are made from high strength, ductile metal alloys in order to handle the loading without failure. As most high dielectric materials typically used in gap sub assemblies are either significantly lower strength than metal alloys or highly brittle, the mechanical strength of the gap sub becomes a significant design hurdle. The gap sub tends to be a weaker link in the drill string.

SUMMARY

This invention has a number of aspects. These aspects include, without limitation, gap subs having extended gaps, EM telemetry systems, EM telemetry signal generators, and methods for EM telemetry.

One example aspect provides gap subs having extended gaps. Another example aspect provides electromagnetic telemetry systems that incorporate and/or are designed for use with gap subs having extended gaps. Another example aspect provides electromagnetic telemetry methods involving the use of gap subs having extended gaps and/or the generation of electrical signals for electromagnetic telemetry suitable for use with gap subs having extended gaps.

Further aspects of the invention and features of a wide range of non-limiting embodiments of the invention are described below and/or illustrated in the drawings.

BRIEF DESCRIPTION OF THE FIGURES

The accompanying drawings illustrate non-limiting embodiments of the invention.

DETAILED DESCRIPTION

Figure 1:
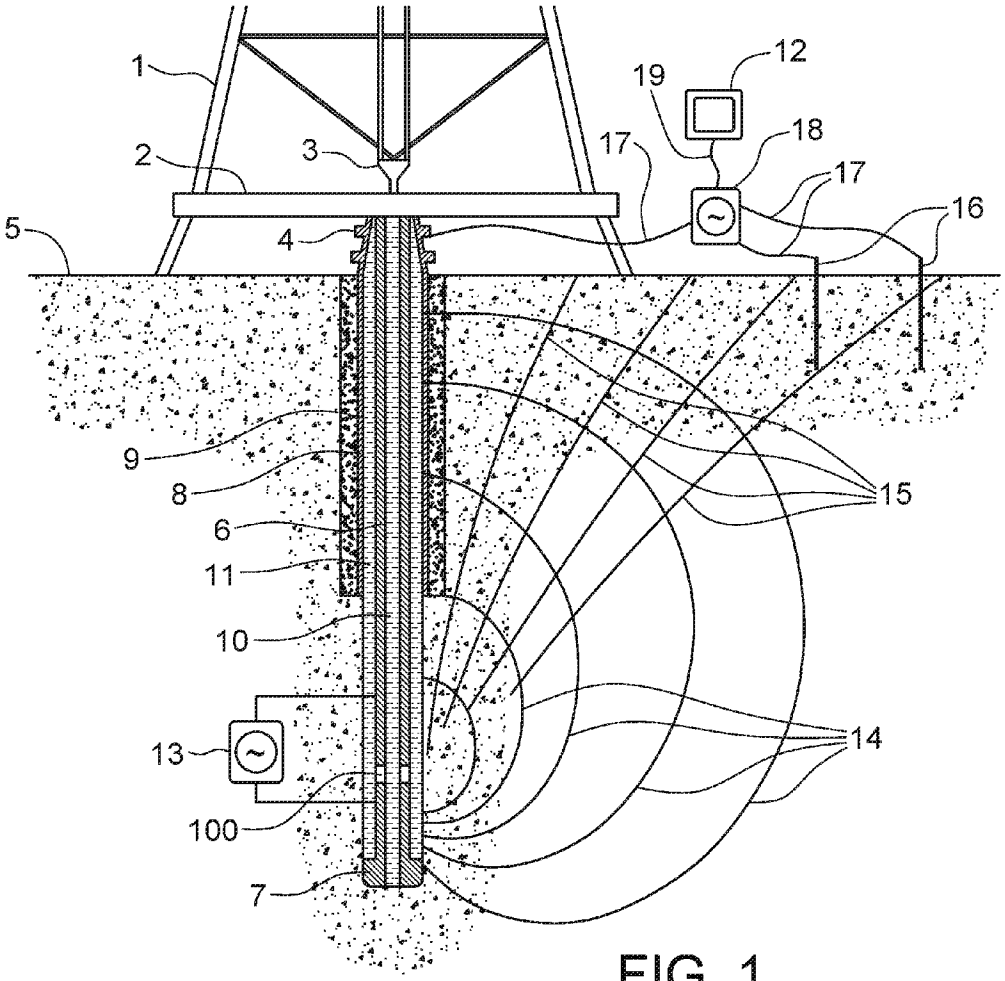
FIG. 1 is a schematic illustration showing a drilling site in which electromagnetic (EM) telemetry is being used for measurement while drilling in which embodiments of the invention can be employed.

The embodiments described herein generally relate to gap sub assemblies for electromagnetic (EM) telemetry in downhole drilling. The gap sub assemblies provide high levels of resistance between sections of drill string which are used as the elements of a dipole antenna.

The gaps provided by typical conventional gap subs range from less than 1 inch (less than 2½ cm) to a few inches (e.g. 20 cm or so). This invention provides gap subs which present longer gaps. For example, gap subs having gaps of at least 1 foot (30 cm) may be used for EM telemetry. Such gap subs can offer significant advantages over gap subs which have smaller gaps. In some embodiments, gap subs may provide gaps that are more than 3 feet (more than about 1 meter) or 4 feet (more than about 1⅓ meters) across. In some cases the gaps may equal or exceed 10 feet (about 3 meters) across. In some embodiments gaps may be 30 feet or more (about 10 meters or more across).

By providing longer gaps, the gap subs described herein can provide higher effective resistances between the sections of drill string separated by the gap sub. Any current which flows from one section to the other must transverse a longer distance through earth or drilling fluid. The resistance of earth and drilling fluid is roughly proportional to distance, and thus a longer gap provides correspondingly greater resistance.

Gap subs having long gaps (e.g. longer than 1 foot (30 cm)) may have any of a wide range of constructions. Various non-limiting examples are described herein. In other embodiments the details of construction of the gap subs may differ.

Some embodiments provide a gap sub construction in which a framework is compressed between uphole and downhole shoulders. The framework may comprise metal parts but is electrically insulating overall. The framework may be filled with a suitable dielectric material. In such embodiments the framework can stiffen the gap sub against bending forces and can protect the dielectric material against damage from contact with material in the wellbore.

In some embodiments the framework comprises a plurality of metal rings that are spaced apart from one another and from other electrically-conductive parts of the gap sub by electrically-insulating bodies. The electrically insulating bodies comprise ceramic spheres in some embodiments.

The example gap sub assemblies described below include a collar in a gap section. The collar may be of significant length, providing an extended gap section. The collar may be provided by one or more members that extend circumferentially around the gap sub and are supported by a plurality of discrete bodies. In some embodiments the circumferential members comprise rings. In a non-limiting example embodiment the rings are metal rings and the discrete bodies comprise ceramic spheres. The rings and discrete bodies may be embedded in an electrically-insulating material. The rings may be shaped to provide recesses to receive the discrete bodies. The collar may be under compression.

The collar may be generally described as including a framework with a plurality of discrete bodies spaced within the framework. In some embodiments a portion of each of the discrete bodies protrudes radially outwardly past the framework. Either or both of the framework and the discrete bodies are made of an electrical insulator material.

The collar is supported between two parts of the gap sub assembly. In some embodiments the gap sub assembly comprises a female member comprising a female mating section and a male member comprising a male mating section and a gap section. The male mating section is matingly received within the female mating section and electrically isolated therefrom. The insulating collar is positioned on the gap section.

The collar therefore provides significant resistance between the male member and the female member. The male member, female member and insulating collar function as the "gap sub" for EM telemetry. The male member and female member may each comprise a suitable coupling (e.g. an API standard threaded coupling) for coupling the gap sub to uphole and downhole parts of the drill string.

FIG. 1 is a schematic representation of a drill site in which EM telemetry is being applied to transmit data to the surface. Gap sub assemblies according to embodiments of the present invention may be employed in transmitting EM telemetry signals. Downhole drilling equipment including a derrick 1 with a rig floor 2 and draw works 3 facilitate rotation of drill pipe 6 in the ground 5. The drill pipe 6 is enclosed in casing 8 which is fixed in position by casing cement 9. Drilling fluid 10 is pumped down drill pipe 6 and through an electrically isolating gap sub assembly 100 to drill bit 7. The drilling fluid returns to the surface by way of annular space 11 and passes through a blow out preventer (BOP) 4 positioned above the ground surface.

The gap sub assembly 100 may be positioned, for example, at the top of the BHA, with the BHA and the drill pipe 6 each forming part of a dipole antenna structure. Ends of gap sub assembly 100 are electrically isolated from one another. Gap sub assembly 100 effectively provides an insulating break, known as a gap, between the bottom of the drill string with the BHA and the larger top portion of the drill string. The top portion may include the rest of the drill pipe 6 up to the surface, for example.

A very low frequency alternating electrical current 14 is generated by an EM carrier frequency generator 13 and driven across the gap sub assembly 100. The low frequency AC voltage is controlled in a timed/coded sequence to energize the earth and create an electrical field 15 that can be detected at the surface, for example, by measuring a potential difference between the drill string and a ground reference. In the illustrated embodiment, communication cables 17 transmit the measurable voltage differential between the top of the drill string and various surface grounding rods 16 located about the drill site to a signal receiver box 18. The grounding rods 16 may be randomly located on site with some attention to site operations and safety. A receiver box communication cable 19 transmits the data received to a rig display 12 to provide measurement while drilling information to the rig operator.

Figure 2:
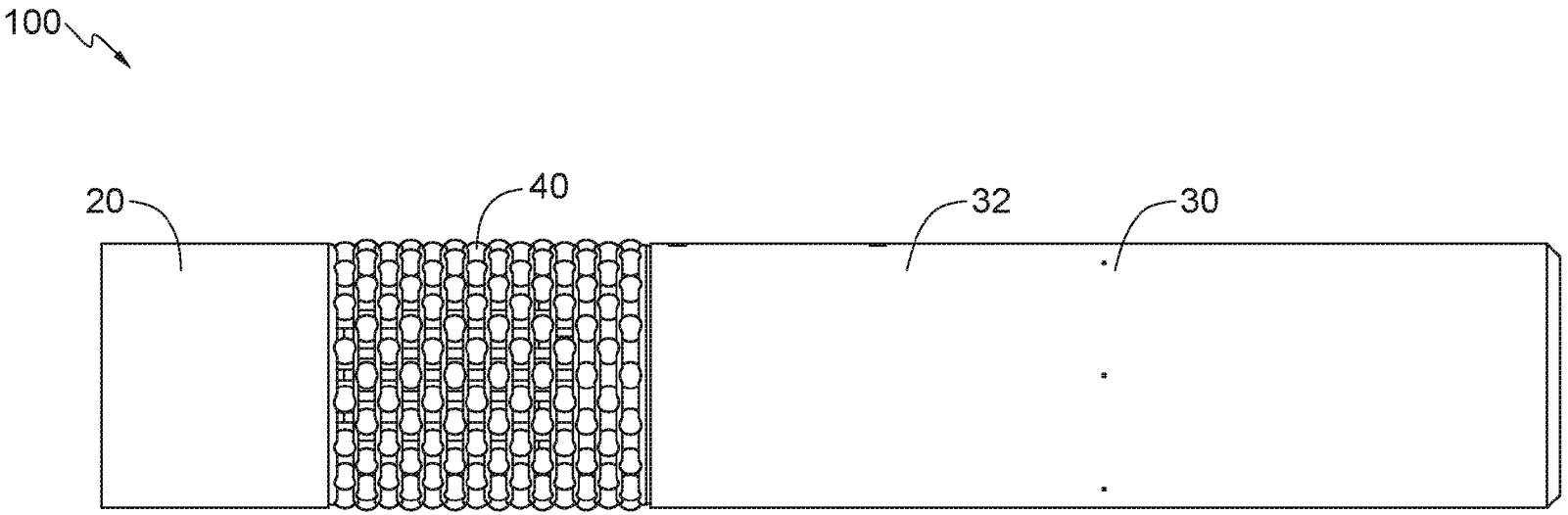
FIG. 2 is side view of a gap sub assembly according to a first embodiment.
Figure 3:
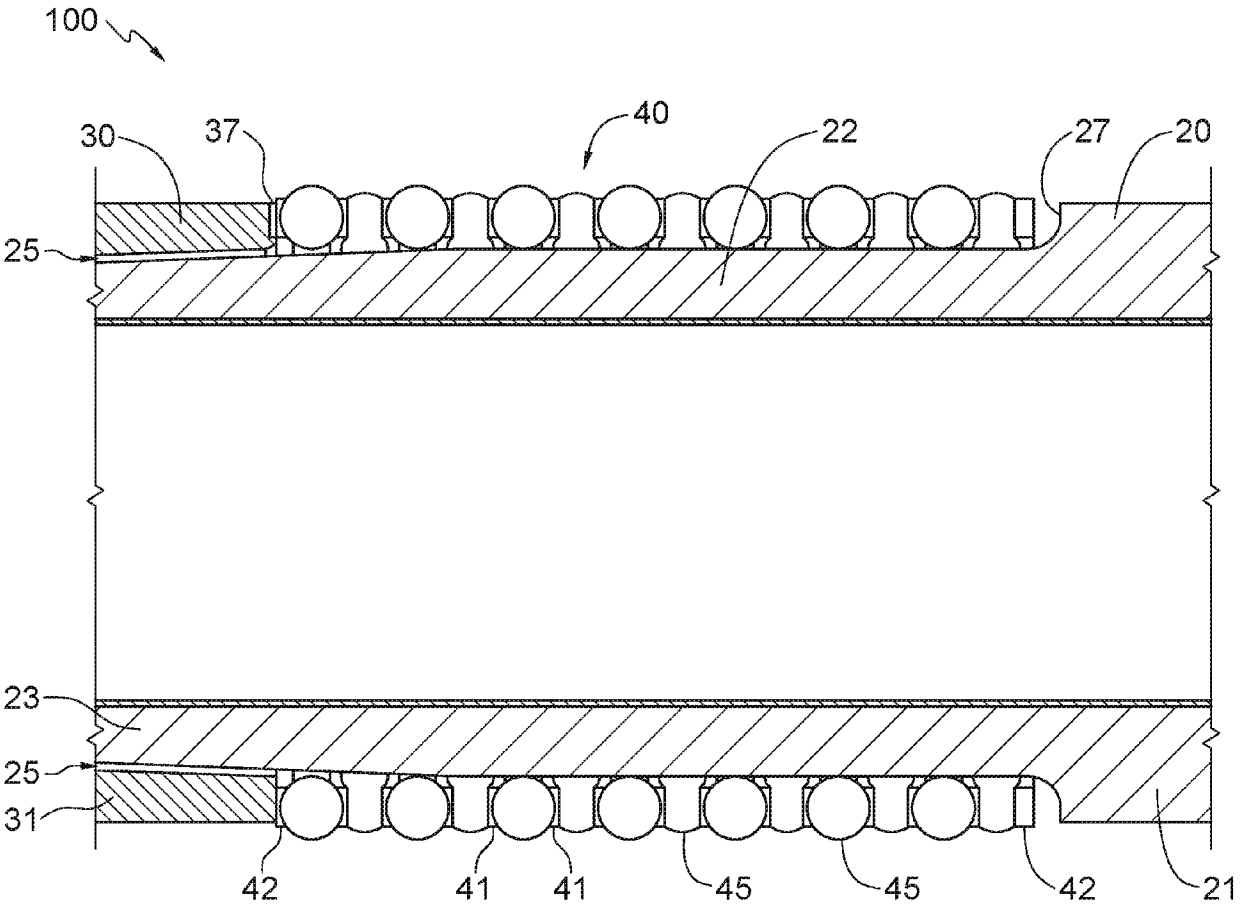
FIG. 3 is a cross sectional partial view of the gap sub assembly of FIG. 2.

FIGS. 2 and 3 illustrate an example gap sub assembly 100 in accordance with an example embodiment of the invention. Gap sub assembly 100 includes a male member 20 mated with a female member 30 and an insulating collar 40 positioned on the male member 20 between a first shoulder 27 on the male member and a second shoulder 37 on the female member. When the gap sub assembly 100 is positioned in the drill pipe 6 as shown FIG. 1, the female member 30 may be uphole and the male member 20 may be downhole although this orientation is not mandatory.

Figure 4A:
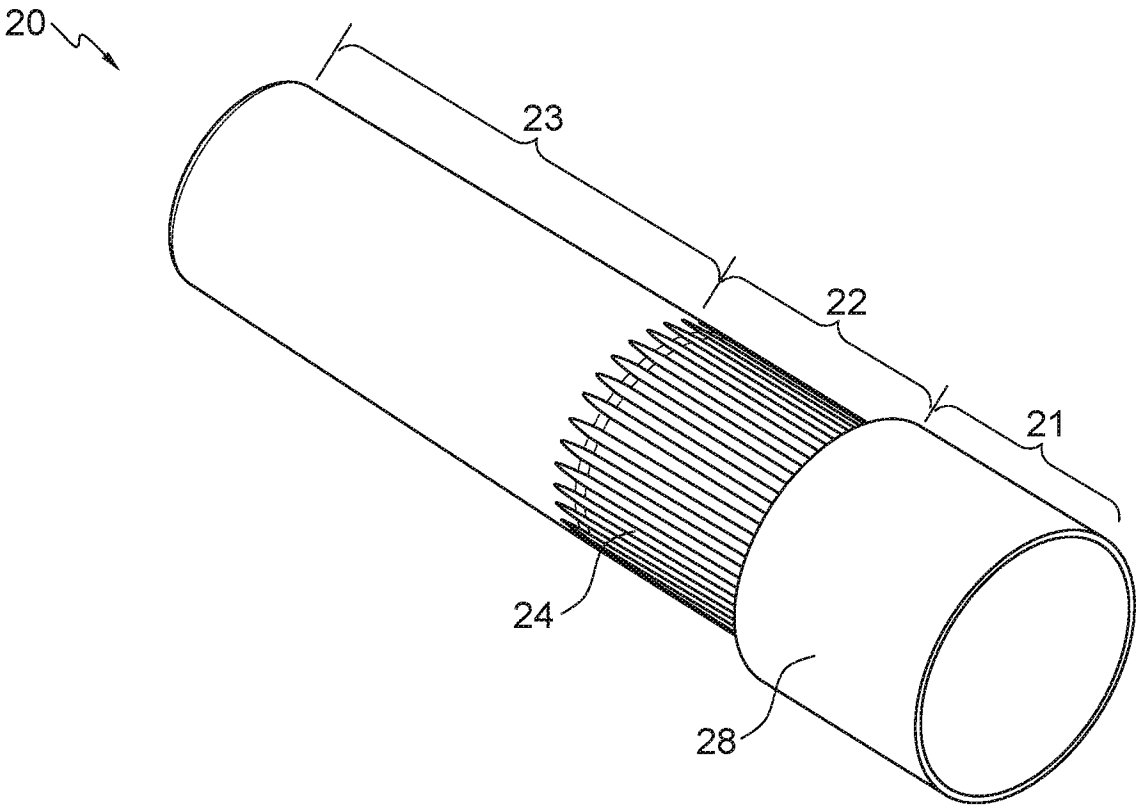
FIG. 4A is a perspective view and FIG. 4B is a side view of a male member of the gap sub assembly of FIG. 2.
Figure 4B:
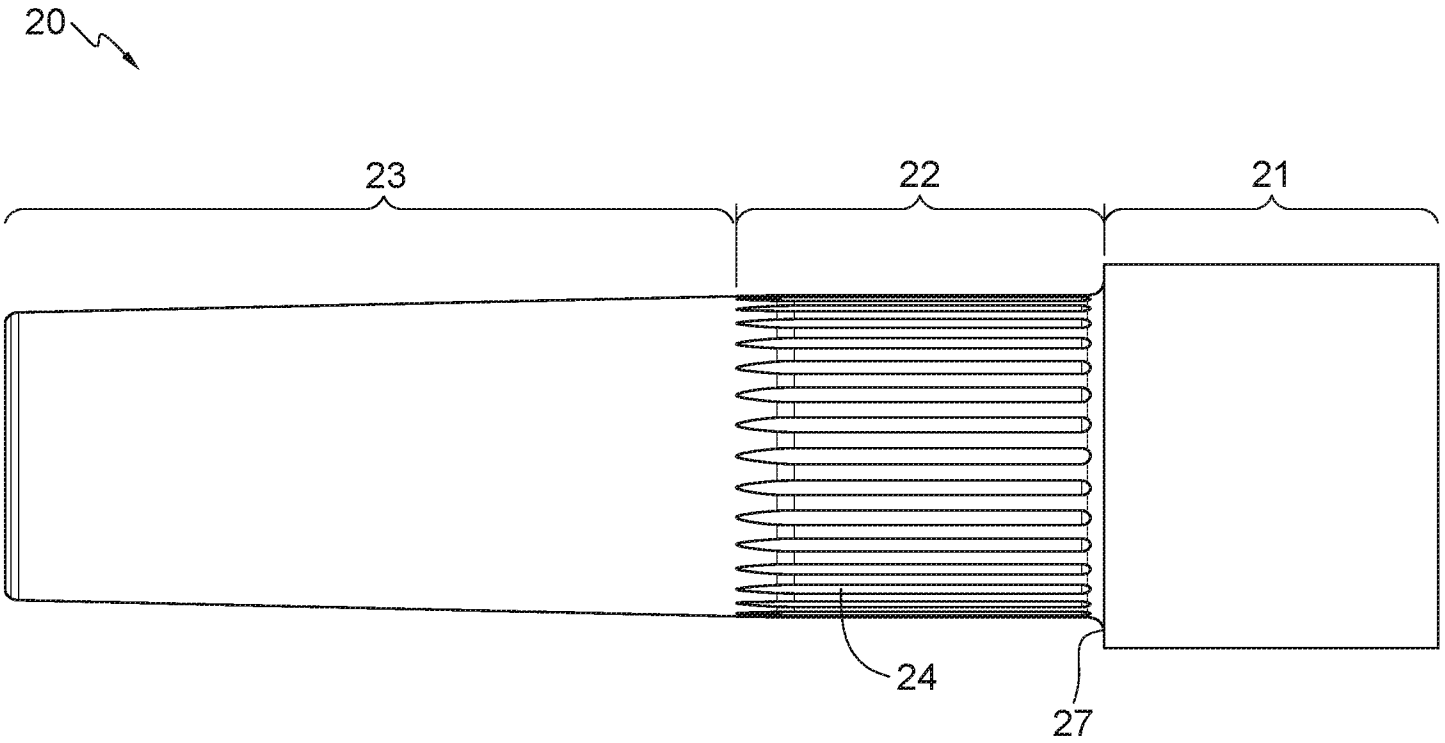

As shown in FIGS. 4A and 4B, male member 20 comprises an electrically conductive body 28 with a bore therethrough. Body 28 may be circular in cross-section. Body 28 has a shoulder section 21, a middle gap section 22 and a mating section 23. Shoulder section 21 has a diameter greater than the diameters of gap section 22 and mating section 23, and forms part of the external surface of the gap sub assembly 100 shown in FIG. 2. Shoulder section 21 includes an annular shoulder 27 adjacent to gap section 22.

Mating section 23 is tapered and has an external diameter that gradually decreases such that the external diameter of mating section 23 in the area adjacent gap section 22 is greater than the external diameter of mating section 23 at its end furthest from gap section 22.

Female member 30 comprises an electrically conductive body 32 with a bore therethrough. Body 32 of female member 30 may be circular in cross section. Body 32 has a mating section 31 and a non-mating section. The internal surface of mating section 31 has a taper that corresponds to the taper of male mating section 23. The internal diameter of each part of female mating section 31 is greater than the external diameter of the corresponding part of male mating section 23 so that female mating section 31 fits over the male mating section 23 in the assembled gap sub assembly 100 as shown in FIG. 3.

Male and female mating sections 23, 31 are dimensioned such that there is a small radial gap 25 between the external surface of male mating section 23 and the internal surface of female mating section 31 when the male and female members 20, 30 are mated together. A high dielectric, non-conductive material can be injected, inserted, placed or filled, etc. into radial gap 25. This material may be introduced into gap 25, for example in any manner known in the art.

In alternative embodiments, the male and female mating sections may not be tapered. Additionally, or alternatively, other structures, for example, but not limited to grooves, threads or rings (not shown) may be included on the internal surface of the female mating section 31 and/or the external surface of the male mating section 23 to facilitate mating of the male and female members 20, 30.

FIG. 3 shows a male member 20 and female member 30 in mating relationship. Collar 40 is positioned on the gap section 22 between an annular female shoulder 37 on one end of the female mating section 31 and male annular shoulder 27. The distance between shoulders 27 and 37 may define the length of the gap which may exceed 1 foot (30 cm) in some embodiments.

In some embodiments, collar 40 is compressed between shoulders 27 and 37. In some embodiments, collar 40 is compressed with a pressure of between 500 psi and 8000 psi. Collar 40 may be rigid under compression such that the interaction between collar 40 and shoulders 27 and 37 stiffens gap sub assembly 100 against bending. This construction tends to prevent or reduce flexure of the gap section 22 by transmitting mechanical loads resulting from flexing of gap section 22 into shoulders 27, 37.

In different embodiments, collar 40 may have different lengths. In embodiments in which collar 40 is relatively longer, the resistance between male member 20 and female member 30 is relatively greater. It can be appreciated that collar 40 may be made as long as desired.

FIGS. 5 to 9 show an example insulating collar 40 comprising a plurality of internal rings 41 positioned between two end rings 42. A plurality of discrete bodies, which in the embodiment shown in FIGS. 5 to 9 are spheres 45, are seated between adjacent rings 41, 42. Insulating collar 40 can be longer or shorter depending on the number of internal rings 41.

In one embodiment, rings 41, 42 are made of a metal or metal alloy, for example, but not limited to, copper, copper alloys (e.g. beryllium copper), aluminium or stainless steel. In such embodiments spheres 45 are made of an electrical insulator material, for example, but not limited to, ceramic, plastic, plastic coated metals, composite or carbides. In an alternative embodiment, the rings 41, 42 are made of an electrical insulator material, for example, but not limited to plastic and the spheres 45 are made of a metal or metal alloy. In other alternative embodiments, both rings 41 and 42 and spheres 45 are made of electrically insulating material(s).

Spheres 45 or other discrete bodies may support rings 41 and 42 with their internal faces spaced apart from male member 20. Thus, even if rings 41, 42 are made of materials that are electrically conducting, rings 41, 42 do not provide a direct electrically-conducting path to the material of male member 20.

Internal rings 41 have two opposed side faces 44 extending between an internal face 46 and an opposed external face 47. End rings 42 have an inner side face 48 and an opposed outer side face 49 spaced between an internal face 50 and an external face 51. In the embodiment shown, the end ring internal and external faces 50, 51 are thicker than the internal and external faces 46, 47 of internal rings 41.

Figure 14:
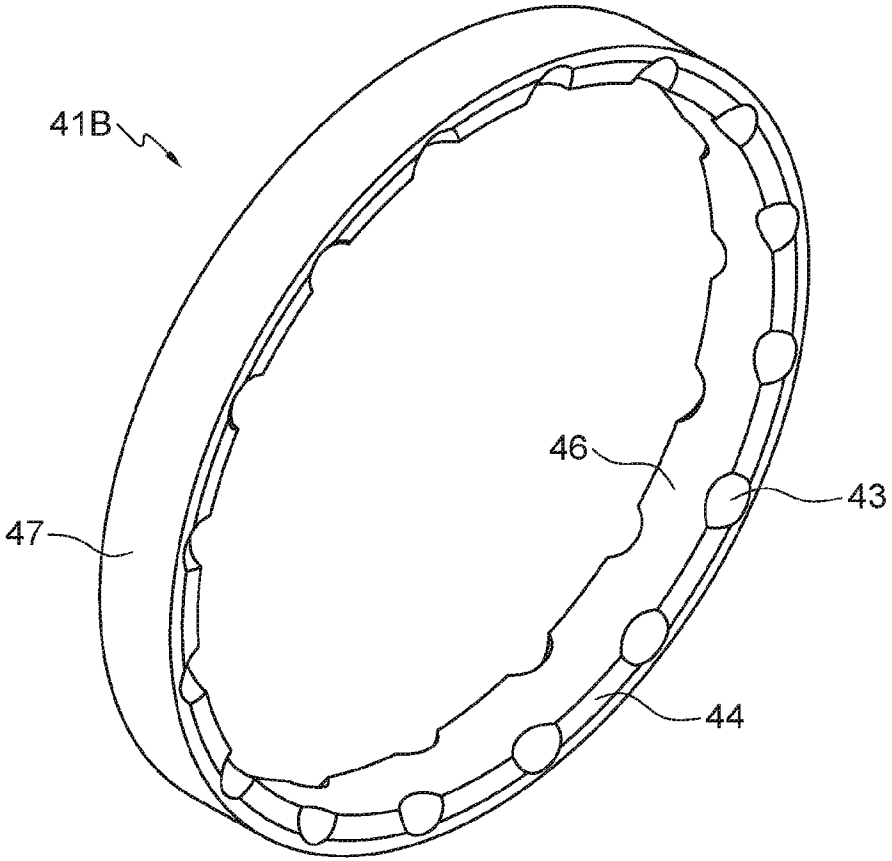
FIG. 14 is a perspective view of an internal ring of an insulating collar according to an example embodiment.

FIG. 14 illustrates a ring 41*b* according to an alternative design. Ring 41*b* is similar to rings 41 except that it is tapered in thickness such that outer parts of ring 41*b* close to external face 47 are thicker than inner parts of ring 41*b* closer to internal face 46. In some embodiments ring 41*b* tapers to an edge at which side faces 44 meet. In such embodiments internal face 46 may be very narrow.

When the internal rings 41 are made of metal or metal alloy, it may be beneficial for the internal ring internal and external faces 46, 47 to be thin so as to provide minimal electrically conductive material within the non-conductive gap of the gap sub assembly 100. A greater thickness to the end ring internal and external faces 50, 51 may provide structural stability to the collar 40.

In alternative embodiments (not shown) the internal ring internal and external faces 46, 47 may be the same thickness as the end ring internal and external faces 50, 51, or the internal ring internal and external faces 46, 47 may be thicker than the end ring internal and external faces 50, 51 or the rings 41, 42 may be of varying size, shape, and placement for various structural requirements.

In some embodiments, rings 41 and 42 trap spheres 45 or other discrete bodies against male member 20. This is accomplished in some embodiments by making side faces 44 of rings 41 beveled. In some embodiment side faces 44 have pockets for receiving spheres 45 or other bodies.

Figure 14B:
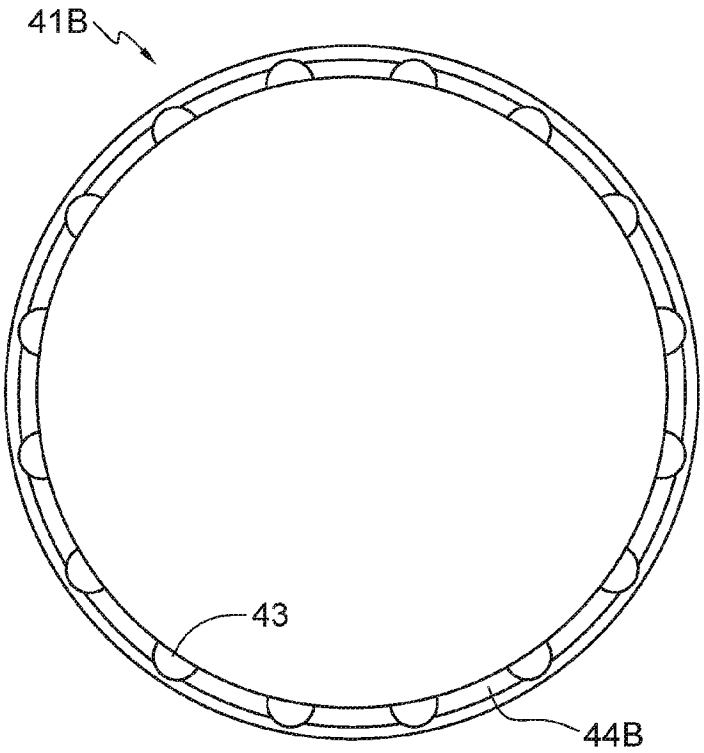
FIGS. 14A and 14B are front and back views of the internal ring of FIG. 14.
Figure 14A:
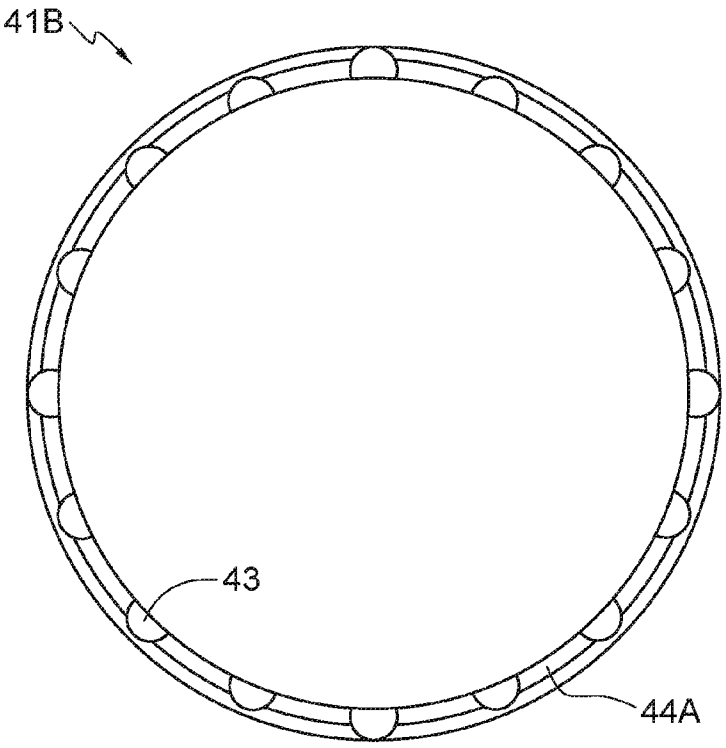

In the embodiments illustrated in FIGS. 14A and 14B, side faces 44 of the internal rings 41 have a plurality of surface depressions or dimples 43 spaced around their surfaces. Dimples 43 on one side face 44A of each internal ring 41 are offset with the dimples 43 on the opposed side face 44B. Offsetting of dimples 43 on opposed side faces 44A and 44B of internal rings 41 allows for thinner internal rings 41 as the dimples 43 are offset rather than back to back. As discussed above, the use of thinner internal rings 41 reduces the amount of electrically conductive material within the non-conductive gap of the gap sub assembly 100 when the internal rings 41 are made of metal or metal alloy. Furthermore more spheres 45 can be included in the collar 40 when the internal rings 41 are thinner. This may increase the wear resistance of collar 40 as will be discussed in more detail below.

The inner side face 48 of each of the end rings 42 also has a plurality of dimples 43 spaced around the surface thereof. The outer side face 49 may be smooth so that it can butt against the male or female shoulder 27, 37. It is not necessary for there to be dimples 43 in outer side face 49.

Collar 40 may be assembled on the gap section 22 before mating the male and female members 20, 30 together. One of end rings 42 is placed over gap section 22 and positioned with its outer side face 49 adjacent to male shoulder 27. Internal rings 41 are then stacked onto the gap section 22 followed by the other end ring 42 with its inner side face 48 facing the side face 44 of the adjacent internal ring 41. The length of collar 40 may be scaled to match a desired separation between shoulders 27, 37 by adding additional rings 41. Thus, gap lengths of 6 inches (15 cm) or more or 1 foot (30 cm) or more are readily achievable. In some embodiments the number of rings 41 is at least 6 or 12 or 200.

Rings 41, 42 are positioned such that the dimples 43 of adjacently facing internal ring side faces 44 are aligned and the dimples 43 of the end ring inner side faces 48 and the adjacently facing internal ring side face 44 are aligned. Spheres 45 are positioned between the rings 41, 42 and sit in the aligned dimples 43. The profile of the dimples 43 correspond to the curved profiles of spheres 45, thereby securing each sphere 45 between the side faces 44, 48 in the assembled collar 40.

Alternatively, the stacked rings 41, 42 and spheres 45 may be assembled to form collar 40 before positioning the collar 40 onto gap section 22.

The outer surface of male member 20 may include recesses such as dimples, holes or grooves that receive spheres 45. For example, gap section 22 may have a plurality of longitudinally extending grooves 24 spaced around the circumference of the external surface of gap section 22. The number of grooves 24 is dictated by the design of the collar 40 as will be discussed in detail below. The geometry of the grooves 24 (depth, placement, profile, length, etc.) is a function of the geometry of the collar 40 and gap section 22. The sides of spheres 45 facing toward gap section 22 may be received in grooves 24.

Collar 40 may be positioned on gap section 22 such that each of spheres 45 sits in one of longitudinal grooves 24 of gap section 22. In the embodiments shown in FIGS. 4A and 4B, there are thirty two grooves 24 spaced around the circumference of the gap section 22. This allows for spheres 45 in each of the offset layers of the collar 40 shown in FIG. 5 to be received in one of grooves 24. In alternative embodiments (not shown), the number of grooves 24 may vary. This number of grooves 24 provided in a specific embodiment may depend on the number of spheres 45 in each layer and the offset arrangement of the collar layers. For example, a collar made up of the rings 41, 42 of FIG. 10 may have sixteen spheres 45 in each layer, however the layers are not offset, therefore only sixteen grooves 24 need to be present on the gap section to receive each sphere 45. Positioning of the spheres 45 in the longitudinal grooves 24 locks collar 40 (or 140, 240) in place. This beneficially prevents rotation or torsional movement of the collar 40, 140, 240 and thereby may increase the torsional strength of gap section 22.

Dimples 43 may be uniformly spaced around rings 41. Grooves 24 may be uniformly spaced around the circumference of gap section 22.

The spacing of the dimples 43 around the side faces 44 of the internal rings 41 and the inner side face 48 of the end rings 42 is such that there are gaps between the spheres 45 seated in the dimples 43.

In the embodiments shown in FIGS. 5 to 9 rings 41 and 42 have sixteen dimples 43 uniformly spaced around each of the internal ring side faces 44 and each of the end ring inner side faces 48. Sixteen spheres 45 are therefore seated between a pair of adjacent rings 41, 42, which make up one layer of the collar 40. The spheres 45 of each layer have an angular spacing of Y degrees.

Figure 9:
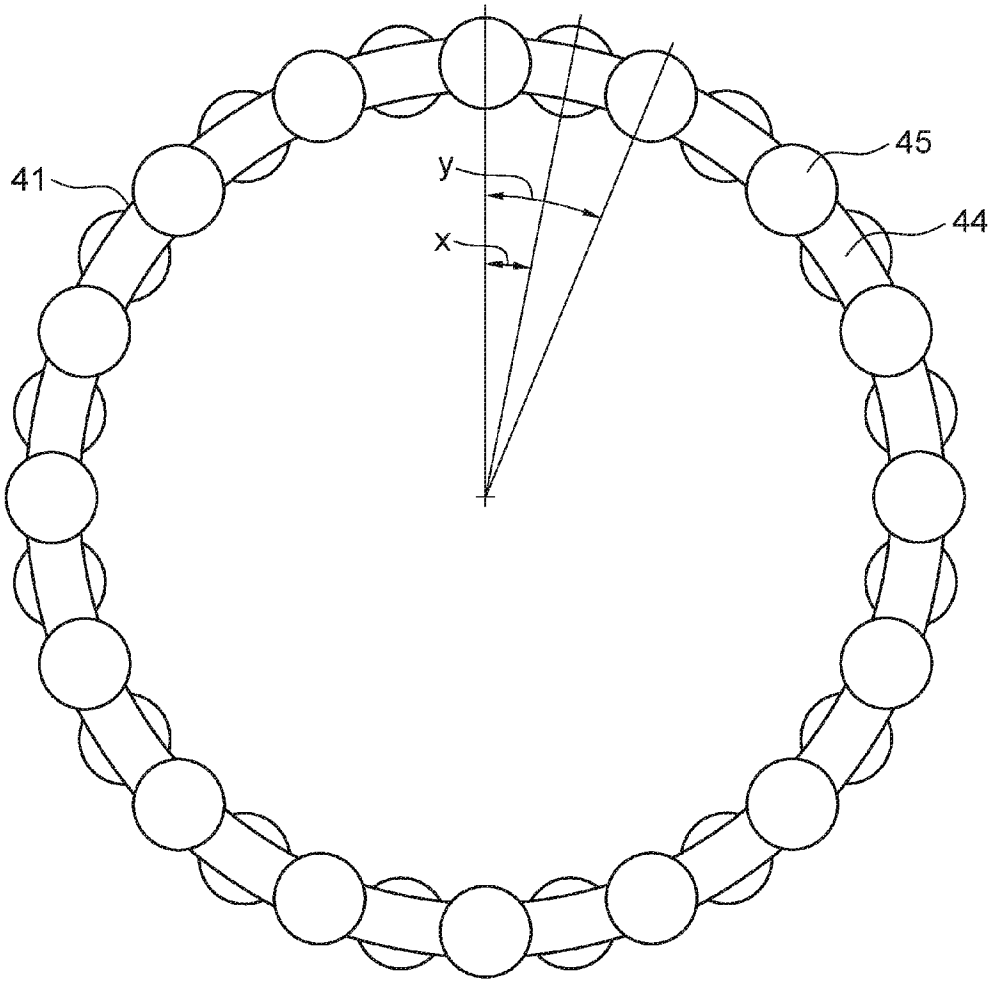
FIG. 9 is a face view of an internal ring of the insulating collar of FIG. 5 showing ceramic spheres seated in surface depressions on opposed side faces of the internal ring.

In the exemplary embodiment shown in FIG. 9, there are sixteen spheres 45 and Y is 22.5 degrees. As a result of offsetting of the dimples 45 of opposed side faces 44 of each of the internal rings 41, the spheres of two adjacent layers are also angularly offset. The angular offset of spheres 45 in adjacent layers is X degrees. In the exemplary embodiment shown in FIG. 9, X is one half the angle of the radial spacing of the spheres 45 in the adjacent layer, therefore X is 11.25 degrees. The spheres 45 of each layer are therefore located in alternating fashion when viewed longitudinally along the collar 40, with alignment of the spheres 45 of layers 1, 3, 5 etc and alignment of the spheres 45 of layers 2, 4, 6 etc.

In an alternative embodiment as shown in FIGS. 12 and 13A-C, the outer side face 49*a* of end rings 42*a* of insulating collar 40*a* include spaced dimples 43 and corresponding aligning dimples 43 are included on the surfaces of male and female shoulders 27*a*, 37*a* of male and female members 20*a*, 30*a* respectively. The dimples 43 on the male shoulder 27*a* align with the longitudinal grooves 24*a* of the gap section 22*a*. Spheres 45 are positioned between the end rings 42*a* and the male and female shoulders 27*a*, 37*a*. In an alternative embodiment (not shown) only one of the end rings 42*a* and one of the corresponding male or female shoulders 27*a*, 37*a* may have dimples 43 thereon for positioning of spheres 45 therein.

The dimples 43 of the outer side face 49*a* of each end ring 42*a* are offset from the dimples 43 on the inner side face 48*a* of that end ring 42*a*, so that the spheres 45 positioned between the outer side faces 49*a* and the male and female shoulders 27*a*, 37*a* are offset from the spheres 45 in adjacent layers of collar 40*a*. In an alternative embodiment (not shown) the dimples 43 on the outer side face 49*a* of each end ring 42*a* align back to back with the dimples 43 on the inner side face 48*a* of that end ring 42*a*.

In alternative embodiments (not shown) the number of spheres 45 in each layer may be more or less than sixteen depending on the size of the rings 41, 42, the size of the spheres 45 and the spacing between each sphere 45. Furthermore, the spacing of the dimples 43, and thus the spheres 45, may be random rather than uniform. Furthermore, in an alternative embodiment (not shown), the radial offset X of spheres 45 of adjacent layers of the collar 40 may be more than or less than half the radial spacing Y between the spheres 45. For example X may be one third of Y so that spheres of the $1^{st}$, $4^{th}$, $7^{th}$ layer etc. align, spheres of the $2^{nd}$, $5^{th}$, $8^{th}$ layer etc. align, and spheres of the $3^{rd}$, $6^{th}$, $9^{th}$ layers etc. align. Alternative embodiments (not shown) may use a different pattern of radial spacing of spheres 45. Other innovative aspects of the invention apply equally in embodiments such as these.

Figure 10C:
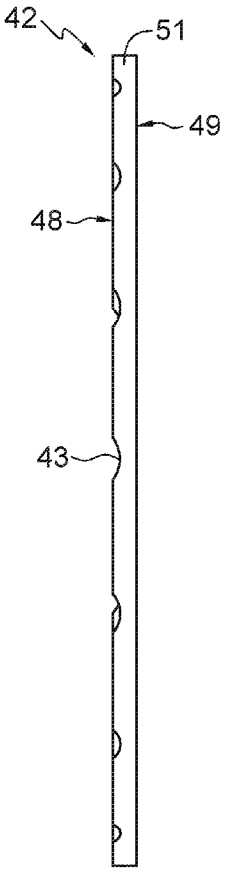
FIGS. 10A, 10B and 10C are side views of an end ring, internal ring and the other end ring respectively according an alternative embodiment of the insulating collar.
Figure 10B:
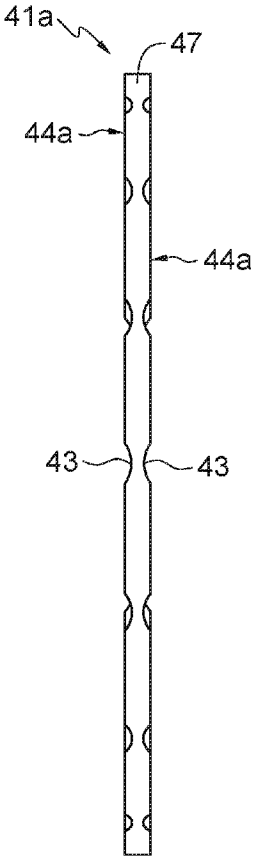
Figure 10A:
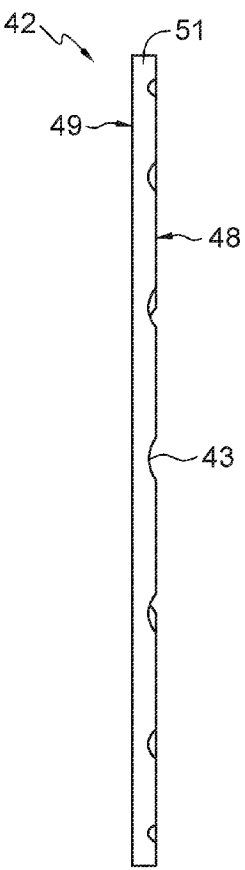

In an alternative embodiment shown in FIG. 10, the internal ring 41*a* has dimples 43 in back to back alignment on each opposed side faces 44*a* of the internal ring 41*a*, such that spheres 45 positioned between the internal and end rings 41*a*, 42 will be aligned rather than offset. Alignment of spheres 45 back to back may beneficially transmit stresses more readily for specific drilling applications and may provide structural strength and stiffness to the collar, which may be important when there are high stresses on the gap sub assembly, for example when the downhole drilling trajectory encompasses a number of curves.

As discussed above with regards to the embodiment shown in FIGS. 5 to 9, the end rings 42 of this alternative embodiment may optionally include dimples 43 on the outer side face 49, such that spheres 45 can be positioned between the end rings 42 and the male and female shoulders 27, 37. The dimples 43 of the outer side face 49 of the end rings 42 may align back to back or may be offset from the dimples 43 on the inner side face 48 of the end rings 42 in this alternative embodiment.

Figure 8C:
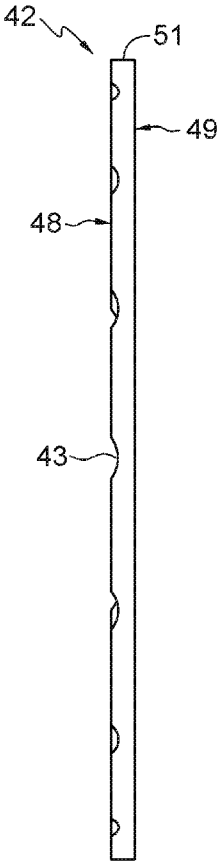
FIGS. 8A, 8B and 8C are side views of the end ring, internal ring and the other end ring respectively of the insulating collar of FIG. 5.
Figure 8B:
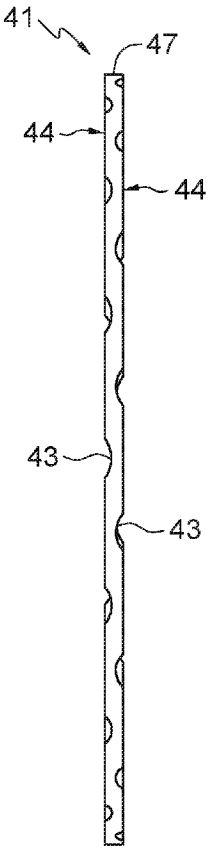
Figure 8A:
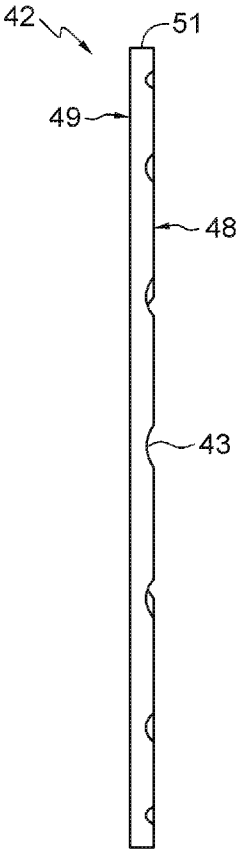
Figure 11:
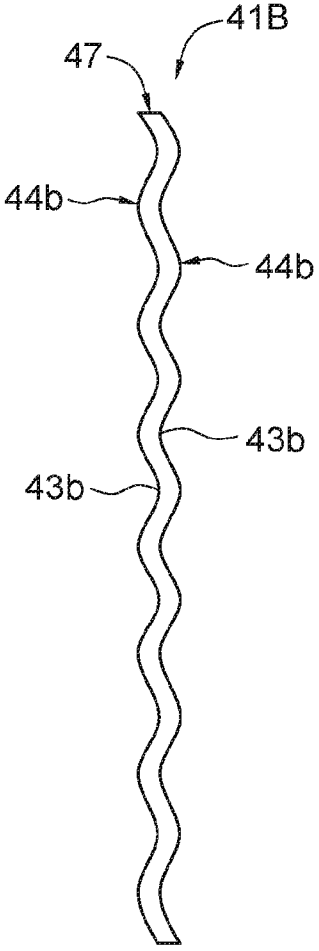
FIG. 11 is a side view of an internal ring according to an alternative embodiment of the insulating collar.
Figure 12:
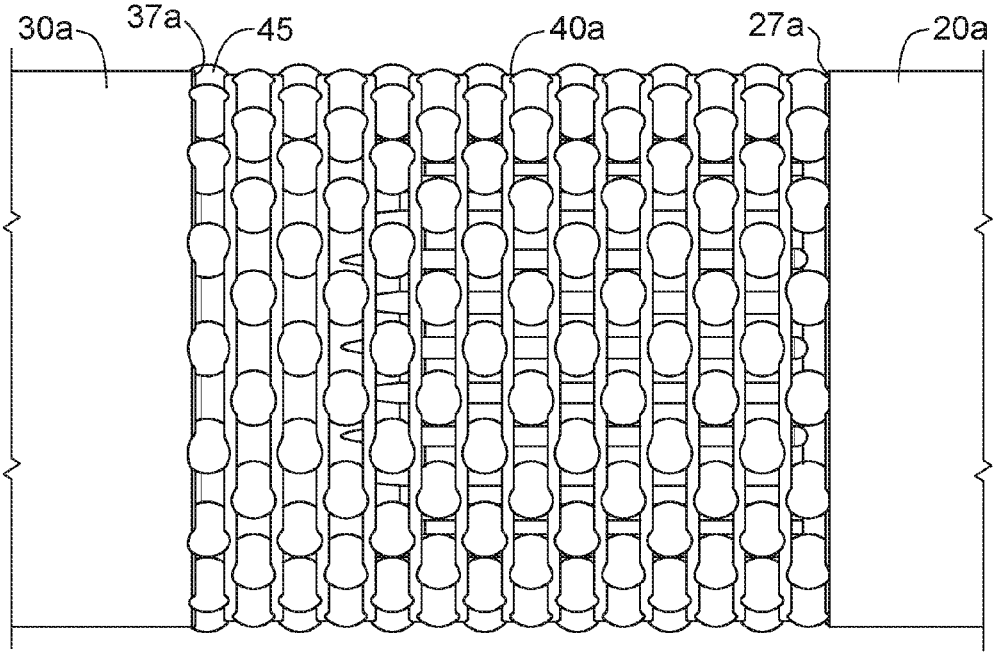
FIG. 12 is a cross sectional partial view of a gap sub assembly according to a second embodiment.
Figure 13A:
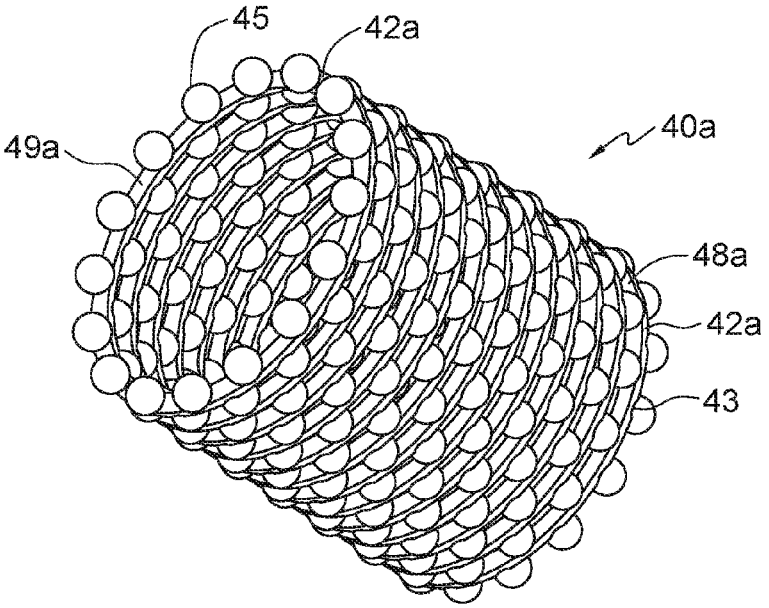
FIGS. 13A, 13B, and 13C are a perspective view of an insulating collar, a perspective partial view of a female member, and a perspective partial view of a male member respectively of the gap sub assembly of FIG. 14.
Figure 13B:
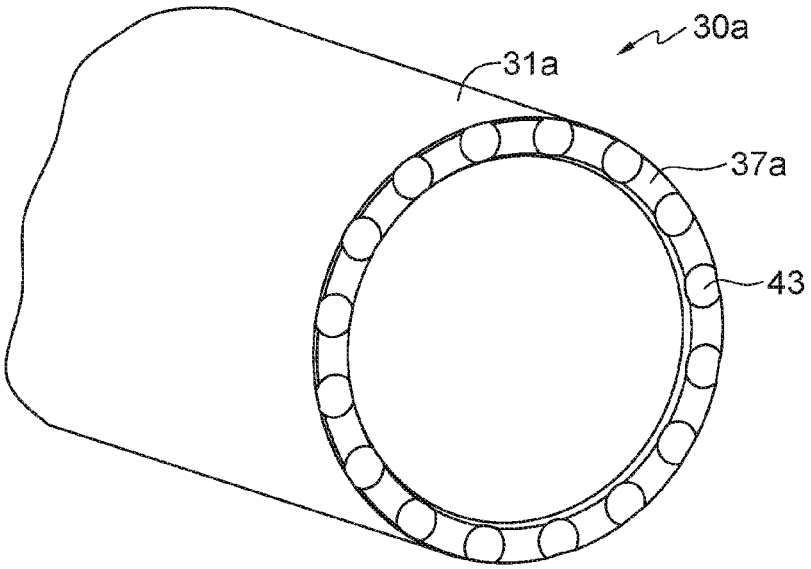
Figure 13C:
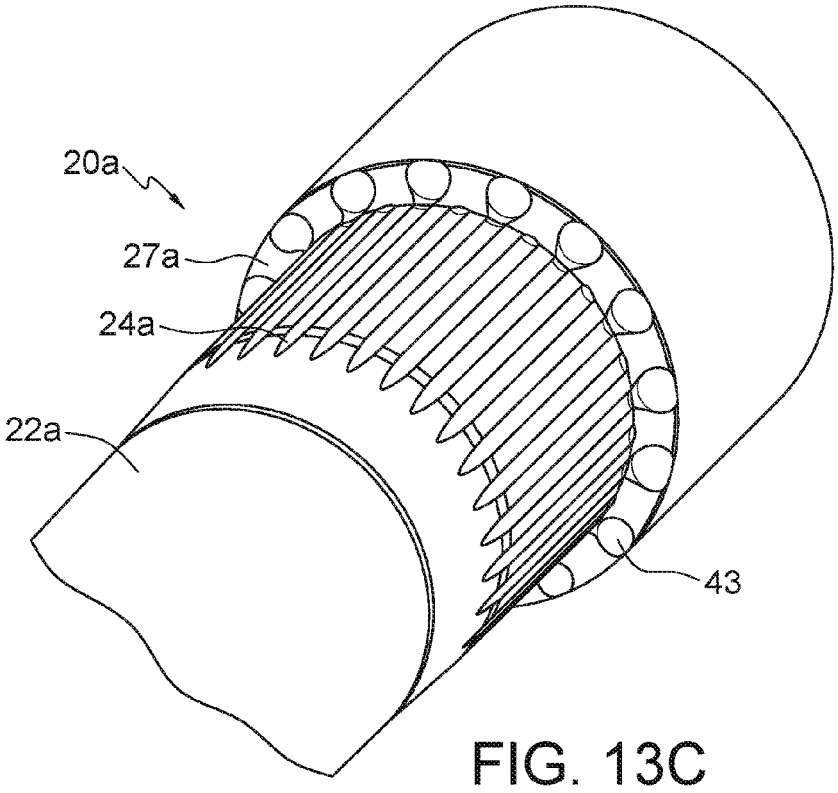

In a further alternative embodiment shown in FIG. 11, an internal ring 41*b* has undulating side faces 44*b* and surface depressions 43*b* are provided as a result of the undulating side faces 44*b*. The surface depressions 43*b* are offset on opposed side faces 44*b* of the internal ring 41*b*. The end rings may also be undulating (not shown) and spheres 45 may be positioned between the surface depressions of the outer side face of the end rings and the male and female shoulders 27, 37. Alternatively, the end rings may be as shown in FIGS. 8 and 10.

It is evident from the foregoing that while the embodiments shown in FIGS. 5 to 11, utilize spheres 45 and dimples 43 or surface depressions 43*b* with a curved profile, in alternative embodiments differently-shaped discrete bodies, such as cuboids, cube, cylinder or egg shaped bodies may be used. In these alternative embodiments the profile of the dimples 43 or surface depressions 43*b* on the internal ring side faces 44, 44*a*, 44*b* and the end ring inner side faces 48 (and optionally the end ring outer side faces 49) may correspond with the profile of the discrete bodies so that the discrete bodies are securely seated between the side faces 44, 44*a*, 44*b*, 48, 49.

Furthermore, in alternative embodiments there may be no dimples 43 on the ring faces 44, 41*a*, 48, 49 and the discrete bodies may be secured between the rings 41, 41*a*, 42 in some other way, for example using an adhesive or another structural feature such as a protrusion from the surface of the rings (not shown). Other innovative aspects of the invention apply equally in embodiments such as these.

It can be desirable to apply compressive pre-load to collar 40. Such preloading may be achieved in various ways.

One way to apply compressive preloading to collar 40 is to insert wedges or the like (not shown) made of any dielectric and/or conductive material between one or both of the male and female shoulders 27, 37 and the outer side face 49 of the adjacent end rings 42.

Another way to apply compressive pre-loading to collar 40 is to press or pull on male and female members 20, 30 so as to force male shoulder 27 toward female shoulder 37 before mating male and female members 20, 30 to one another.

Another way to apply compressive pre-loading to collar 40 is to provide an electrically-insulating threaded coupling between male and female members 20, 30. The threaded coupling may permit drawing male shoulder 27 toward female shoulder 37 by turning male member 20 relative to female member 30. By way of non-limiting example, the threaded coupling may comprise helical grooves formed on an outside diameter of mating section 23 of male member 20 and corresponding helical grooves formed on an inside diameter of mating section 31 of female member 30. The threaded connection may be completed by providing electrically insulating members (such as electrically insulating spheres for example) that engage the grooves in the male and female members. An example of this construction is described elsewhere herein.

Another way to apply compressive loading to collar 40 is to provide high strength electrically insulating rods or cords that extend across gap section 22 (for example between rings 41, 42 and male member 20) and can be tightened to draw shoulders 27, 37 toward one another.

Another way to apply compressive loading to collar 40 is to provide a member adjacent to shoulder 27 that has internal threads that engage corresponding threads on the outer diameter of male member 20 at the end of gap section 22 adjacent to shoulder section 21. The member may be turned relative to male member 20 so that it advances toward shoulder 37 to compress collar 40. The member may have holes passing through it to facilitate filling both sides of the member with a suitable dielectric material as discussed below. In an alternative embodiment a threaded member is adjacent shoulder 37 and can be turned to compress collar 40 against shoulder 27.

Another way to apply compressive loading to collar 40 is to provide a member adjacent to shoulder 27 or 37 that can be forced toward the opposing shoulder 37 or 27 by way of suitable cams, wedges, bolts or the like.

Once collar 40 is positioned on the gap section 22 female member 30 can be mated with male member 20 to form the gap sub assembly 100. Where collar 40 will be compressively pre-loaded then, depending on the mechanism for applying the pre-loading, the preloading may be performed before, after or as part of mating male section 20 to female section 20. A suitable dielectric material may then be applied to fill the spaces around collar 40.

Providing a collar 40 that is compressed can increase resistance of the gap section to bending. Essentially, collar 40 may carry forces between shoulders 27 and 37 thereby resisting bending. Collar 40 functions in place of solid material that would be present in a section of drill string lacking a gap section. A gap section which includes a collar 40 may approximate the resistance to bending of an equivalent section of drill string. In some embodiments, the section of drill string having collar 40 has a Young's modulus which is at least 100%, 99%, 95%, 90%, 80%, 70%, or 50% of the Young's modulus of an equivalent section of drill string that does not have a gap section. An equivalent section of drill string may comprise a section of drill string with the same material, outer diameter and bore diameter as gap sub assembly 100 but made of solid metal.

In some embodiments compressive forces applied to collar 40 are transmitted by way of a ring and the points at which forces are applied to one side face of the ring are angularly offset relative to the points at which forces are applied to the opposing side face of the ring. These forces can therefore cause some bending of the ring which may act as a stiff spring, In such embodiments, forces which attempt to bend the gap sub will attempt to further compress collar 40 along one side of the gap sub. Collar 40 can resist such further compression thereby stiffening the gap sub against bending. The stiffness of collar 40 may be adjusted by selecting the construction of the rings, the material of the rings, the width of the rings, the thickness of the rings, the ring geometry, and/or the number of spheres 45 or other discrete bodies spaced around the rings. Stiffness may be increased by increasing the number of spheres 45 in each layer of collar 40 (all other factors being equal).

Female member 20 may be mated to male member 30 in various ways. For example, the dielectric material may hold male part 20 to female part 30. Projections, indentations or the like may be provided in one or both of male member 20 and female member 30 to better engage the dielectric material.

As another example, male member 20 may be pinned to female member 30 using electrically insulating pins, bolts or the like. Male and female members may also or in the alternative be pinned together with metal pins. The metal pins may be attached at one end to one of male member 20 and female member 30 (for example by being press-fit, welded in place, or the like. The other end of the metal pins may pass through an aperture in the other member (either male member 20 or female member 30). The aperture is large enough that the metal pin does not contact the material of the other member directly. An electrically insulating material fills the space in the aperture surrounding the second end of the metal pin. The electrically insulating material may, for example, comprise a moldable dielectric material. In some embodiments, some pins are attached to male member 20 and pass through apertures in female member 20 and some pins are attached to female member 30 and pass through apertures in male member 20. In each case the pins are electrically insulated from the member that they are not attached to.

In some embodiments, some or all of the pins are made of an insulating material. In some embodiments, some or all of the pins are not directly attached to either male member 20 or female member 30, but are inserted through apertures in female member into a corresponding bore in male member 20. These inserted pins may be held in place by an injected dielectric material, an adhesive, or the force of friction.

A high dielectric, non conductive material, for example, but not limited to, an injectable thermoplastic or epoxy or engineered resin is injected into the radial gap 25 between the external surface of the male mating section 23 and the internal surface of the female mating section 31. The injected dielectric material sets and electrically isolates the male mating section 23 from the female mating section 31, as well as preventing drilling fluid from filling the radial gap 25. The dielectric material may additionally help to attach male member 20 to female member 30.

Figure 15:
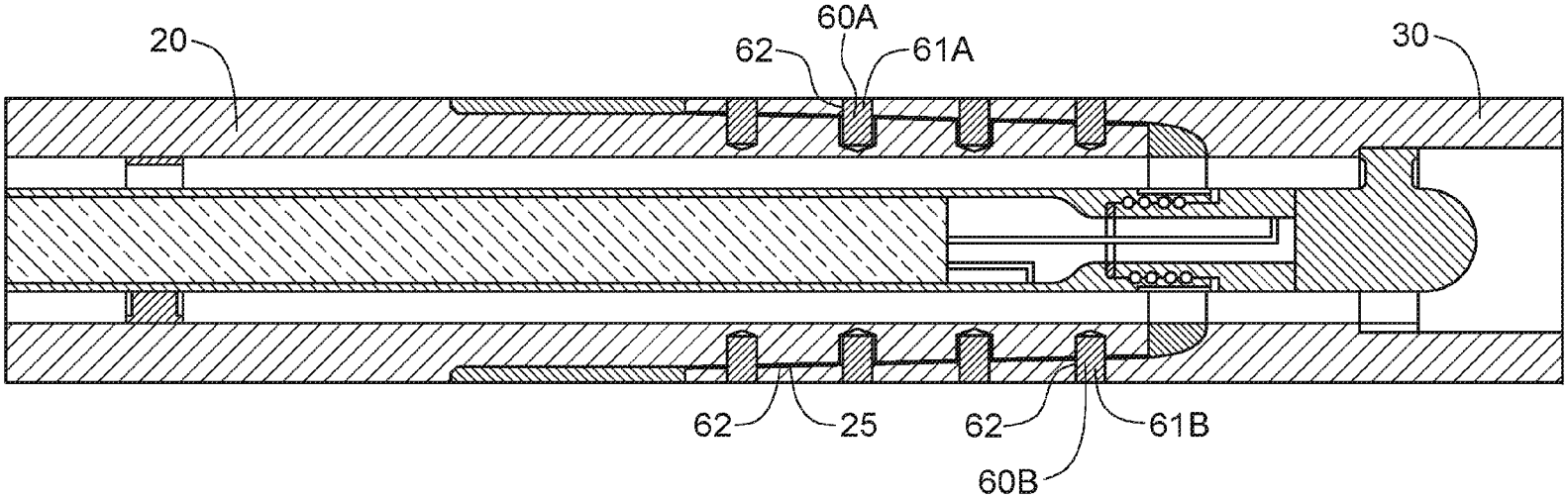
FIG. 15 is a cross sectional view of a pinned connection between a male and a female member according to an example embodiment.

FIG. 15 shows an example of a pinned connection between male member 20 and female member 30. In this example, a pin 60A is attached to and projects outwardly from male member 20 into an aperture 61A in female member 30. A dielectric material 62 fills aperture 61A around pin 60A. Also shown is a pin 60B that is attached to and projects inwardly from female member 30 into an aperture 61B in male member 20. The portion of aperture 61B around pin 60B is filled with dielectric material 62. The dielectric material 62 may also fill the gap 25 between male member 20 and female member 30.

The number of pins and their locations may be varied. Pins 60A and/or 60B may be spaced apart around the circumferences of male member 20 and female member 30. Different pins 60A and/or 60B may be at the same and/or different axial positions along male member 20 and female member 30.

As another example, male member 20 may be held to female member 30 by providing electrically-insulating bodies (e.g. spheres) that engage grooves or other indentations in male member 20 and female member 30. The electrically-insulating bodies may be inserted into gap 25 through apertures in female member 30. An example embodiment having this construction is discussed below and illustrated in FIGS. 16-18. In some embodiments male member 20 has a plurality of sets of grooves in mating section 23 and female member 30 has a corresponding plurality of sets of grooves in mating section 31. The grooves of different ones of the sets of grooves may be non-parallel. For example, one set of grooves may extend circumferentially around mating section 23 and another set of grooves may extend longitudinally in mating section 23. Bodies received in the first set of grooves may assist in resisting tension forces while bodies received in the second set of grooves may assist in resisting torques.

The same or a different dielectric material is injected into the spaces between the spheres 45 in each layer of collar 40 and into the space between the collar 40 and the male and female shoulders 27, 37, such that the spheres 45 and rings 41, 42 (and wedges when present) are immersed in the dielectric material. The injection step may be a one phase step whereby the dielectric material is injected into the radial gap 25 and into all spaces of the collar 40 and gap section 22. Alternatively, the dielectric material may be injected in the spaces of the collar 40 before the male and female members 20, 30 are mated. In some embodiments, dielectric material is injected to fill collar 40 before collar 40 is positioned on gap section 22. In another embodiment the dielectric material is injected into radial gap 25 and into the spaces between rings 41, 42 in a number of steps.

It is advantageous to provide vents (for example, radially extending grooves) on outer side faces 49 of end rings 42. Such vents can aid in ensuring that the injected dielectric material suitably embeds end rings 42. The extrusion of small amounts of dielectric material through such vents can be used as an indication that the dielectric material is filling collar 40.

One advantage of making collar 40 using rings 41, 42 that have a tapered cross-section or otherwise provide undercuts on side faces 44, 48, 49 is that such rings help to retain the dielectric material in the spaces between adjacent rings 41, 42. When rings 41, 42 are tapered the spaces between the rings can be very generally trapezoidal in cross section. A wedging action between the dielectric material in such spaces and the side faces 48, 19 of the rings helps to resist tear out of the dielectric material.

The amount of dielectric material needed is reduced compared to conventional gap sub assemblies as the material need only be injected in the spaces between the spheres 45 rather than covering the whole of the gap section 22.

In the assembled gap sub assembly 100, the spheres 45 in layers of the collar 40 and the dielectric material creates a dielectric space confined by the male and female shoulders 27, 37 and defined by the diameter of the spheres 45 and the geometry of any rings 41, 42 provided.

Figure 5:
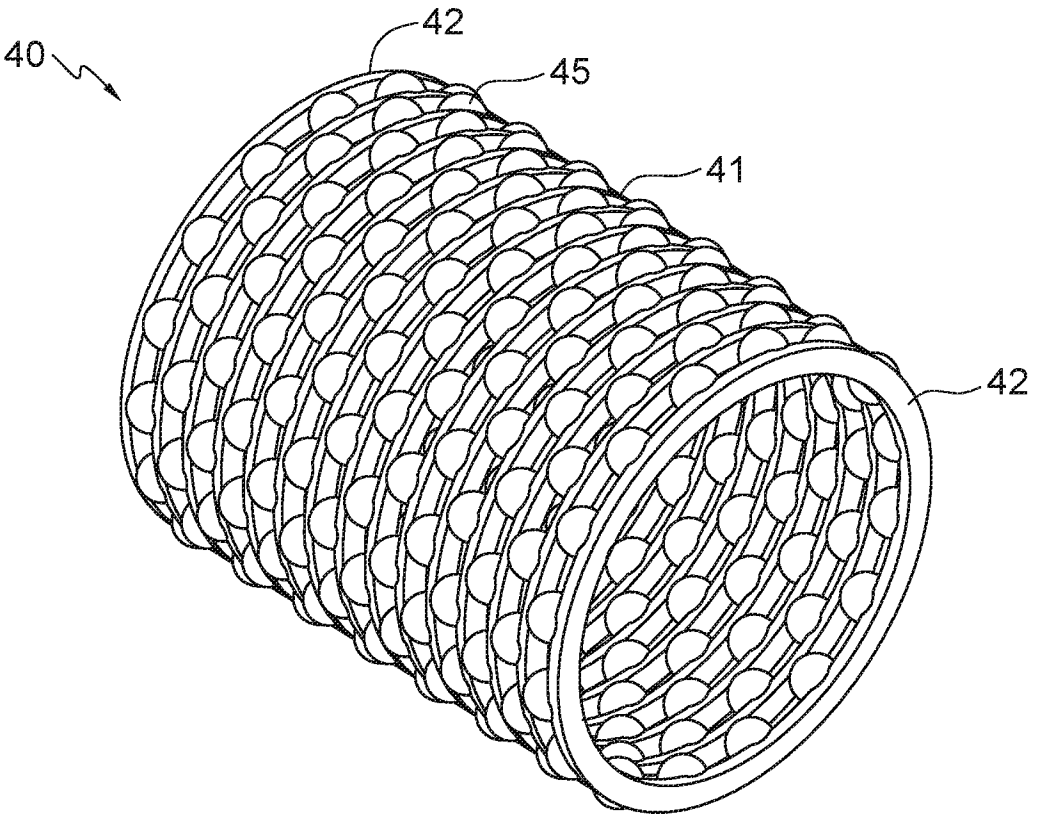
FIG. 5 is a perspective view of an insulating collar of the gap sub assembly of FIG. 2.
Figure 6:
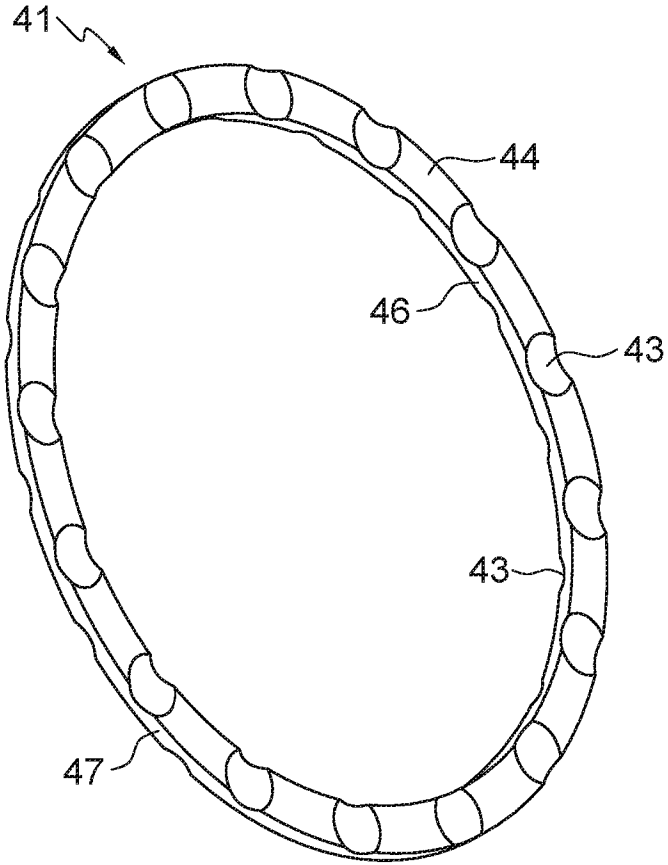
FIG. 6 is a perspective view of an internal ring of the insulating collar of FIG. 5.
Figure 7:
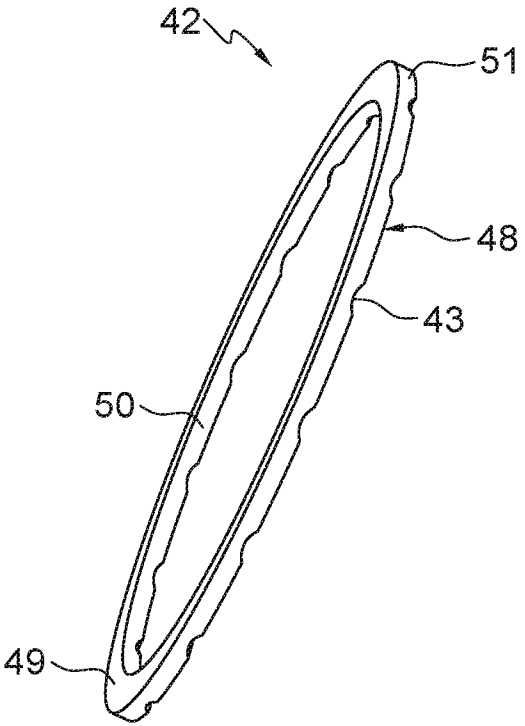
FIG. 7 is a perspective view of an end ring of the insulating collar of FIG. 5.

While the embodiment shown in FIGS. 2, 3 and 5 show the insulating collar 40 with a plurality of internal rings 41, in an alternative embodiment (not shown) there may be only one internal ring 41, 41*a*, 41*b* positioned between the two end rings 42 or positioned directly between shoulders 27, 37.

The number of internal rings 41, 41*a*, 41*b* can be varied depending on the size of the male gap section 22, which beneficially allows collar 40 to be designed to fit any sized gap. An advantage of this construction is that it permits the use of gaps that are much larger than the gaps in current common use. A very large gap can facilitate the use of higher-voltage signals for EM telemetry. This, in turn can result in improved data communication from greater depths and/or from formations that are not ideal for EM telemetry. A further advantage of the use of a very large gap is that the electrical power needed for EM telemetry may be reduced.

A drill string may extend through a formation that presents variable electrical resistance. For example, pockets within the formation may contain salts that cause the pockets to have increased electrical conductivity. If a small gap is used, there may be intermittent signal losses whenever the gap is in a low-resistance portion of the formation. A very large gap decreases the likelihood that the entire gap will be in a low-resistance part of the formation and therefore provides a more reliably large resistance across the gap even where the formation may have small pockets in which the formation has a reduced electrical resistivity (increased electrical conductivity).

While constructions as described herein are well suited for making gap subs having extended gaps, a gap sub having an extended gap may be made using other constructions. The inventive concept of providing a gap sub having a gap much longer than is typical in previously-available gap subs is independent of the specific details of construction described above.

Advantageously, rings 41, 42 may be made of or have their external faces 47, 51 coated with or formed of a hard abrasion-resistant metal. In such embodiments, rings 41, 42 protect the dielectric material that fills the spaces between the rings from abrasion. The material of rings 41, 42 is preferably not so brittle that rings 41 or 42 will break under expected operating conditions.

As shown for example in FIG. 11, in some embodiments, rings 41, 42 may have undulating side faces. Even rings which do not have undulating side faces, may deform as a result of axial compression of collar 40 so that their side faces undulate to some degree. Rings may optionally be machined to provide undulating side faces. Undulating side faces of rings 41 and 42 can be advantageous for helping to prevent scouring of the dielectric material between the rings by formations encountered downhole.

Figure 16:
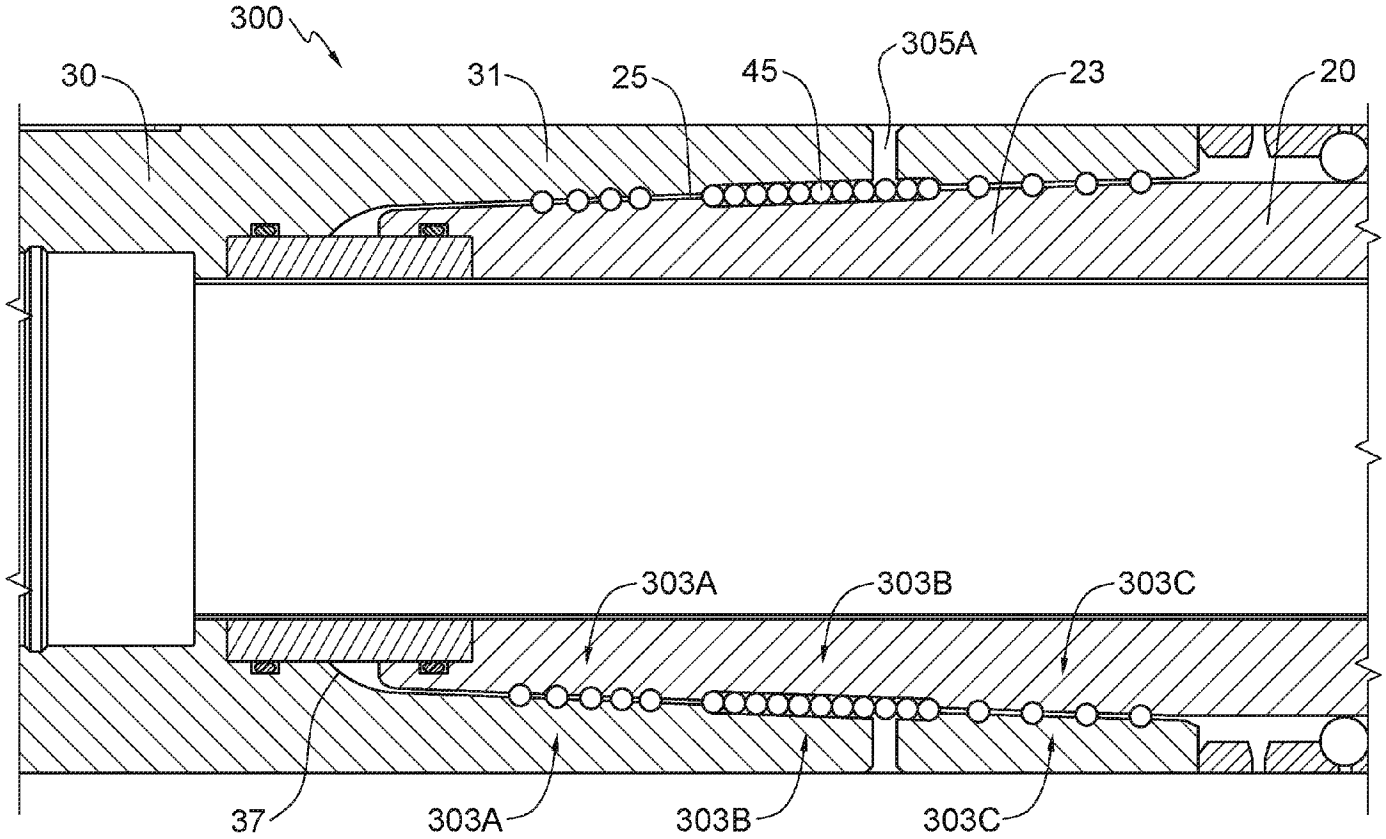
FIG. 16 is a cross sectional view of a connection between a male and a female member according to an example embodiment.
Figure 17:
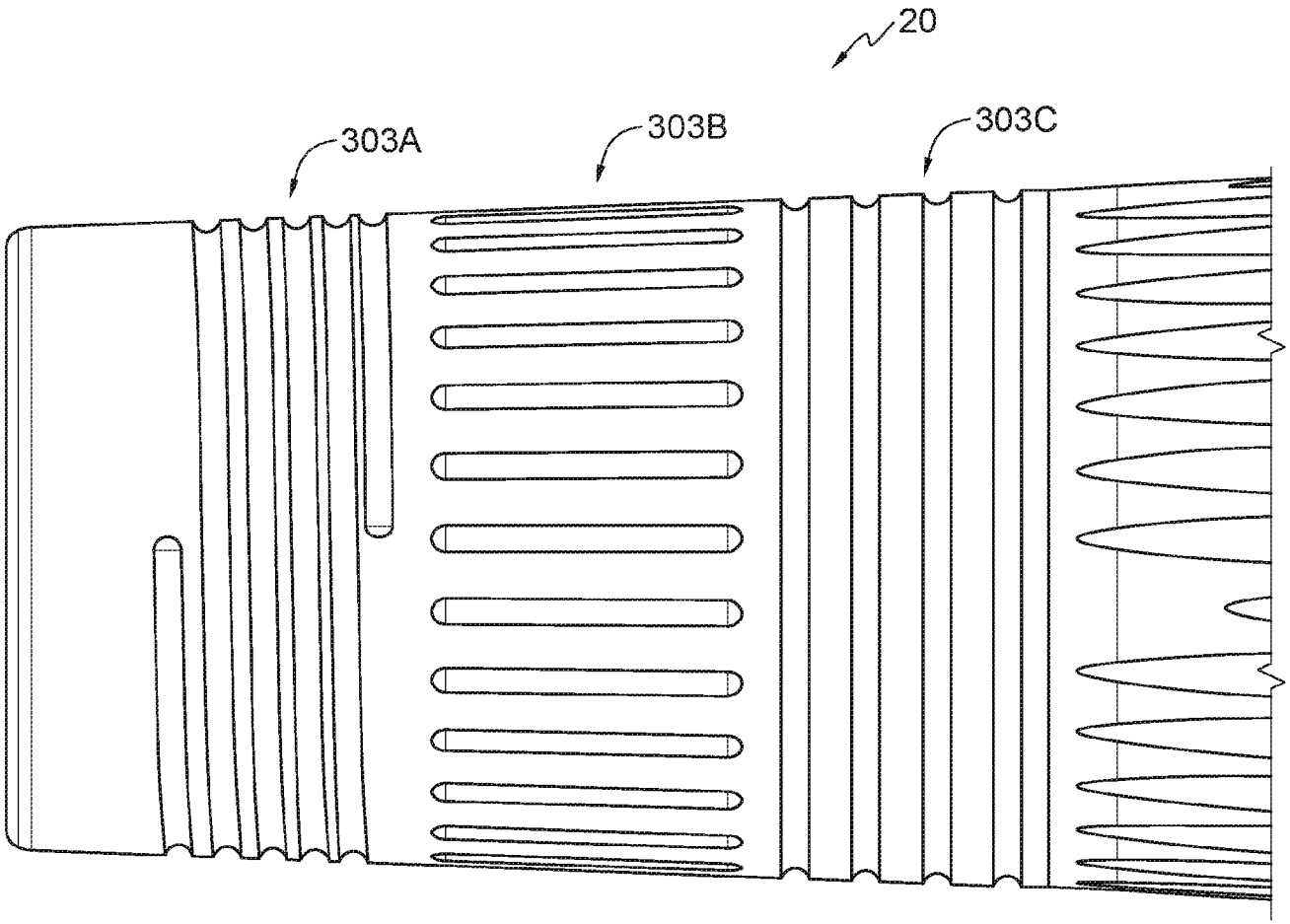
FIGS. 17 and 18 are perspective view of the male and female members, respectively, of the connection in FIG. 16.
Figure 18:
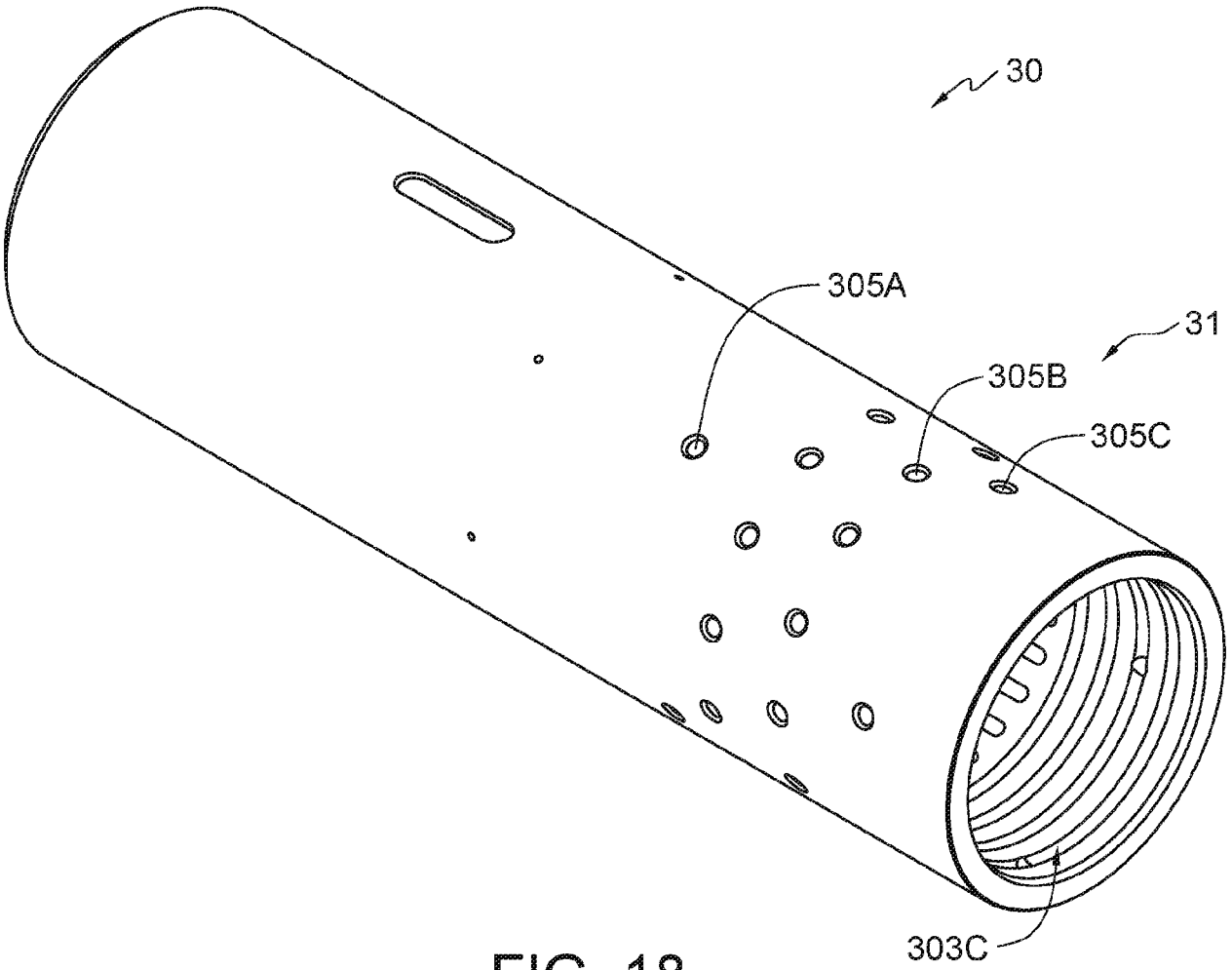

FIGS. 16-18 show a gap sub 300 according to another example embodiment. Gap sub 300 comprises a male part 20 and a female part 30 which may be substantially as described above. A collar 40 is supported between shoulders 27, 37. Gap sub 300 provides three sets of grooves 302A, 302B and 302C in the surfaces of mating part 23 of male part 20 and three corresponding sets of grooves 303A, 303B and 303C in the surface of mating part 31 of female part 30.

Grooves 302A and 303A are helical and are configured to receive spheres 45. For example, spheres 45 may be fed into gap 25 where they span between groove 302A and 303A through an opening 305A that may be capped after spheres 45 have been inserted. It can be appreciated that with spheres 45 are in place as described, twisting female part 30 with respect to male part 20 will result in shoulder 37 moving relative to shoulder 27. Thus, collar 40 may be axially compressed between shoulders 27 and 37 by such rotation.

Grooves 302B, 302C, 303B and 303C may be used to secure male part 20 in the mated relationship relative to female part 30. Circumferential grooves 302B and 303B may be located so that a groove 302B is axially aligned with the corresponding groove 303B when collar 40 has been preloaded in compression to a desired degree. With grooves 302B and 303B so aligned, spheres 45 may be introduced into space 25 such that each sphere spans between a groove 302B and the corresponding groove 303B. The spheres 45 may be introduced, for example, by way of openings 305B that may be plugged after the spheres are in place.

Similarly, male piece 20 and female piece 30 may be rotated relative to one another to achieve angular alignment of each groove 302C with a corresponding one of grooves 303C. When this alignment has been achieved, spheres may be introduced into space 25 such that each sphere spans between a groove 302C and the corresponding groove 303C. The spheres 45 may be introduced, for example, by way of openings 305C that may be plugged after the spheres are in place.

Figure 19:
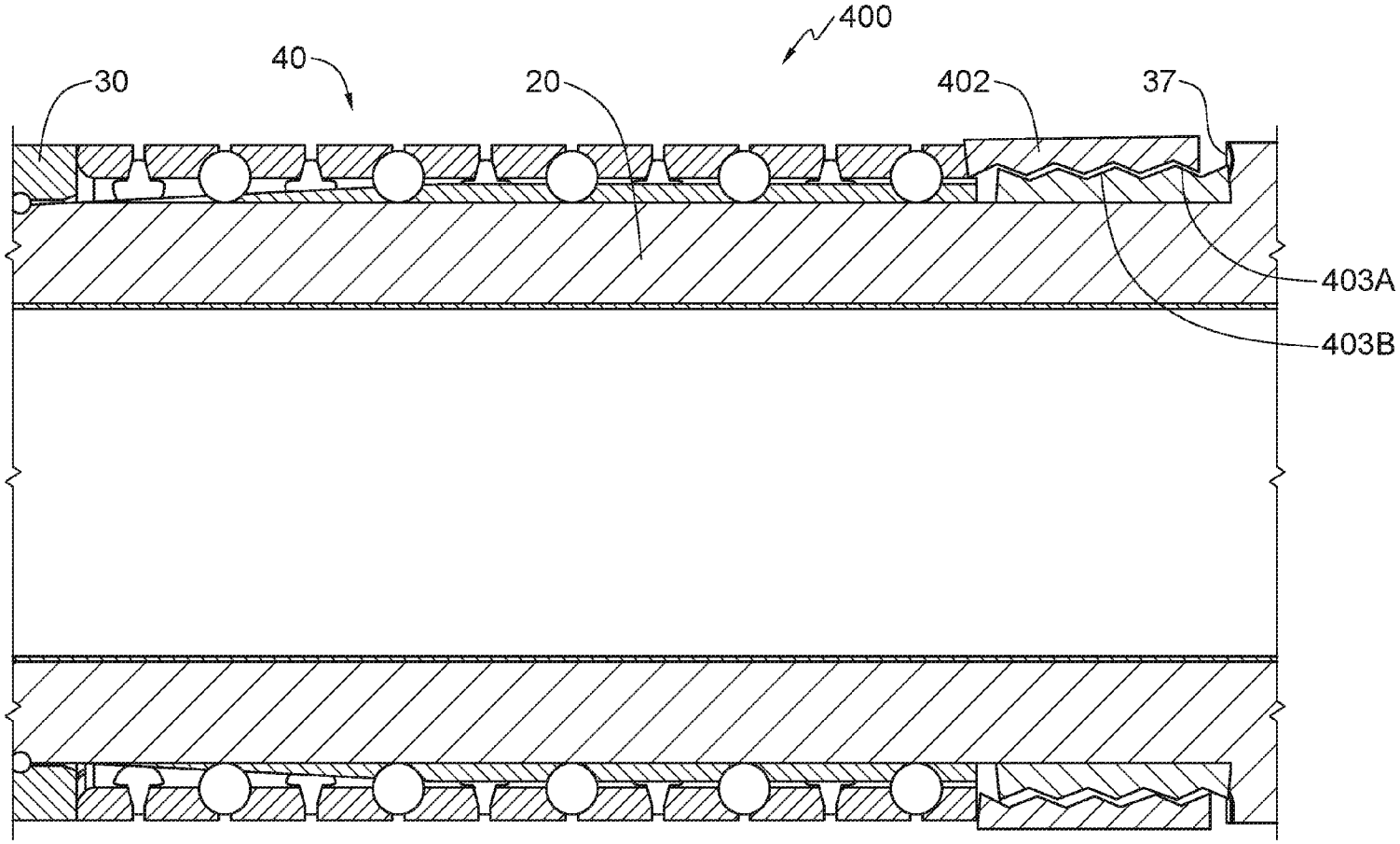
FIG. 19 is a cross section view of a connection between a male and a female member with a compression collar.

FIG. 19 illustrates a gap sub 400 according to a still further example embodiment. Gap sub 400 comprises a male part 20 and a female part 30 which may be substantially as described above. A collar 40 is supported between shoulders 27, 37. An axially-movable compression collar 402 is mounted on male part 20 adjacent to collar 40. Compression collar 40 may be moved to apply compressive preload to collar 40.

In the illustrated embodiment, compression collar 402 has internal threads 403A that engage threads 403B on male part 20. In this embodiment, compression collar 402 may be advanced toward shoulder 27 by turning compression collar 402 relative to male part 20. Compression collar 402 may have may have holes (not shown) passing through it to facilitate filling both sides of the member with a suitable dielectric material.

The injection step is carried out to inject dielectric material in any spaces in the collar 140 and the collar is assembled on the gap section 22 either before or after the injection step as discussed above in connection with FIGS. 5 to 11.

In some embodiments, portions of some or all of spheres 45 project radially outward past the external faces of rings 41, 42. In such embodiments the projecting spheres 45 or other shaped discrete bodies therefore act as the first contact impact zone on the external surface of the collar 40, 140, 240. The discrete bodies may also project radially outward from the external surfaces of the male and female members 20, 30. Side impact loading may beneficially be improved as the projected surface of the discrete bodies typically deflect impact stresses more readily than conventional sleeves positioned over the gap section 22 that may crack or chip. The discrete bodies may also provide a higher resistance to fracture and a higher resistance to wear caused by drilling fluid, thereby increasing the resistance potential of the gap sub assembly 100 of the disclosed embodiments compared to conventional gap sub assemblies. The projecting discrete bodies may serve as wear indicators.

In some embodiments, most of spheres 45 (or other discrete bodies) do not project radially past the external surfaces of rings 41, 42. A few spheres 45 may be mounted so that they do project radially past the external surfaces of rings 41, 42. The projecting spheres or other discrete bodies may serve as wear indicators. Where spheres 45 engage longitudinal grooves 24, some spheres 45 may be made to project radially farther than others by making a few of longitudinal grooves 24 shallower than others and/or by providing shallower portions in one or more of the longitudinal grooves. For example, several of longitudinal grooves 24 spaced apart around the circumference of male member 20 may be made shallower than others. In a specific example embodiment, four of grooves 24 angularly spaced apart by 90 degrees from one another are made shallower than the remainder of longitudinal grooves 24.

In some embodiments some or all of discrete bodies (e.g. spheres 45) are recessed below the outermost surfaces of rings 41 and 42. The distance may be selected such that the discrete bodies begin to protrude when the rings have been worn to the point that the gap sub has reached or is approaching its wear limit.

In alternative embodiments (not shown) longitudinal grooves 24 are not present or are replaced with an alternative structural feature to lock the collar 40, 140, 240 in place. For example, the gap section 22 may include individual surface depression which correspond in shape to the discrete bodies of the collar, or the gap section 22 may include surface protrusions which secure the spheres 45 and/or the rings 41, 41*a*, 41*b*, 42 of the collar 40 or the rings of the helical spring 141 of the collar 140 and secure it in place to prevent rotation or torsional movement. The collar 40, 140, 240 may additionally or alternatively be secured into place in the gap section 22 using adhesives or plastics.

In the embodiments described herein, the collar 40, 140, 240 comprises a framework which may comprise the rings 41, 41*a*, 41*b*, 42 of the embodiments of FIGS. 5 to 11. The framework may be made of a metal or metal alloy, for example, but not limited to, copper, copper alloys, aluminium or stainless steel. Alternatively, or additionally the framework may be made of an insulator material, such as plastic, or a plastic coated metal, or a dielectric non-conductive material such as epoxy or thermoplastic. In some embodiments, exterior faces of rings 41, 41*a*, 41*b*, 42 have a hardness of at least Rc 20, 40, 50, 55, 60, 65, 67, or 69.

The discrete bodies may be made of a metal or metal alloy, for example, but not limited to, copper, copper alloys, aluminium or stainless steel, or the discrete bodies may be made of an electrical insulator material, for example, but not limited to, ceramic, plastic, plastic coated metals, composite or carbides. Exemplary ceramics include, but are not limited to, zirconium dioxide, yttria tetragonal zirconia polycrystal (YTZP), silicon carbide, or composites. In one embodiment, the discrete bodies are made of an insulator material and the framework is made of a metal or metal alloy and/or an insulator material, however in an alternative embodiment, the framework is made of an insulator material and the discrete bodies are made of a metal or metal alloy, and/or an insulator material. In such embodiments when the collar is positioned in the gap section 22 it electrically isolates the male shoulder 27 from the female shoulder 37. It may be beneficial to have the discrete bodies made of an insulator material as the protruding portion of the discrete bodies is in contact with the gap section 22 thereby further electrically isolating the collar 40, 140, 240 from the gap section 22. It may also be beneficial to have at least part of the framework made of a metal or metal alloy to increases the resistance, strength and structural stability of the collar 40, 140, 240 compared to known collars made of non-conductive material such as plastic.

The collar 40, 140, 240 beneficially may provide mechanical strength, structure, stiffness and durability to the gap section 22 and restricts bending of the gap section 22. The gap section 22 can therefore be longer than corresponding gap sections of conventional gap sub assemblies. The downhole EM signal efficiency and signal reception of the EM signal at the surface may therefore be increased as a result of the larger gap section 22. Use of the insulating collar 40, 140, 240 of the disclosed embodiments may increase, amongst other things, the overall bending strength, stiffness, torsion strength and toughness of the gap sub assembly 100. As the gap sub can be one of the weakest links in the drill string, this results in greater longevity, reliability and confidence of the EM tool. The collar 40 is typically able to withstand high temperatures as the structural components of the collar 40, 140, 240 can withstand higher temperatures than injectable thermoplastic and/or epoxies of conventional collars. In some of the embodiments disclosed, the amount of dielectric material which needs to be injected in the spaces between the discrete bodies is reduced compared to a conventional solid dielectric sleeve, which may lead to reduced manufacturing costs, and improved life of the tool.

A number of variations are possible. For example, ceramic rings could be provided in collar 40 in place of spheres 45 in some embodiments.

Figure 20A:
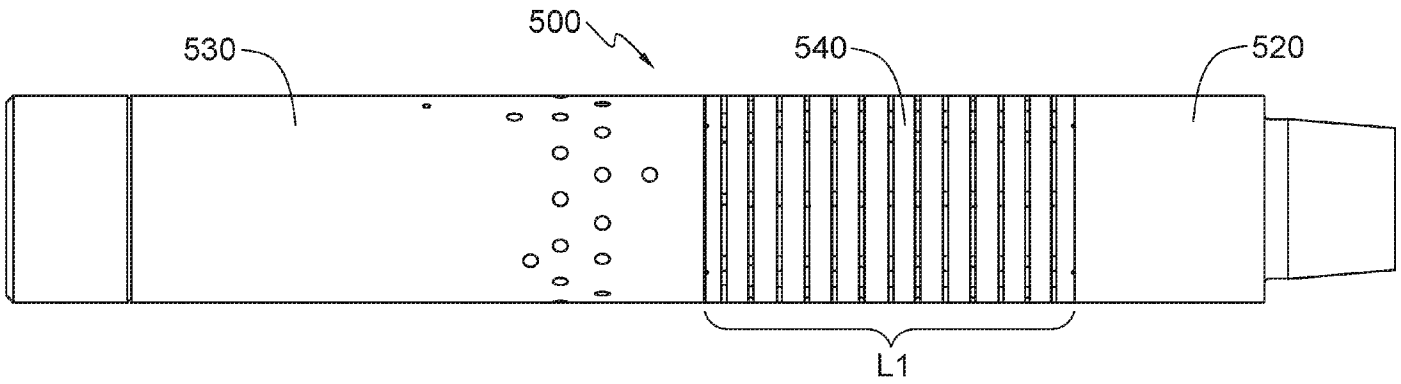
FIGS. 20A and 20B are side and cross-sectional views, respectively, of an example gap sub.
Figure 20B:
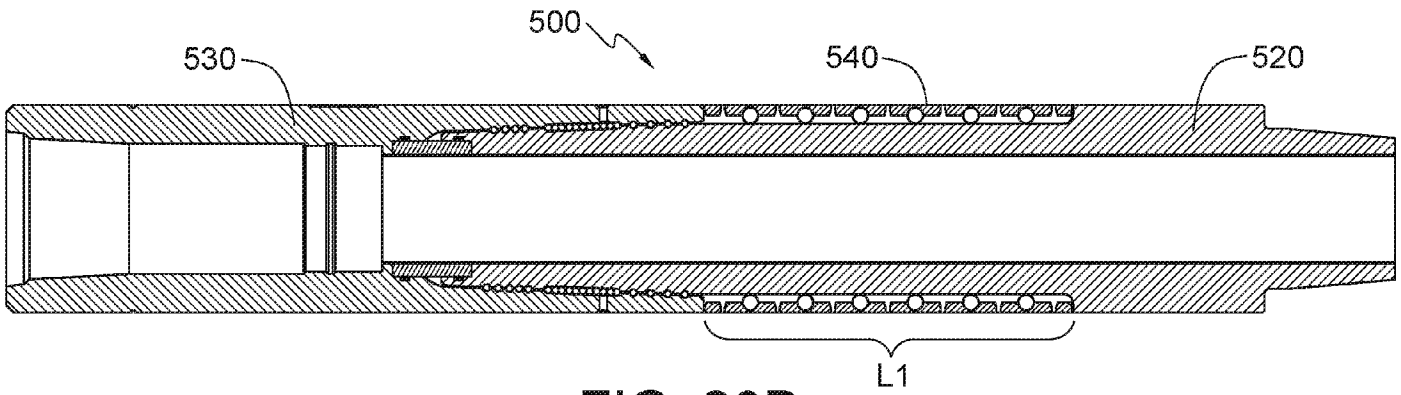

FIGS. 20A and 20B are side and cross-sectional views, respectively, of an example gap sub 500. An insulating collar 540 is located between a male member 520 and a female member 530. Insulating collar 540 has length L1. The resistance experienced by electrical current flowing between male member 520 and female member 530 through drilling fluid (not shown) is R1.

Figure 21A:
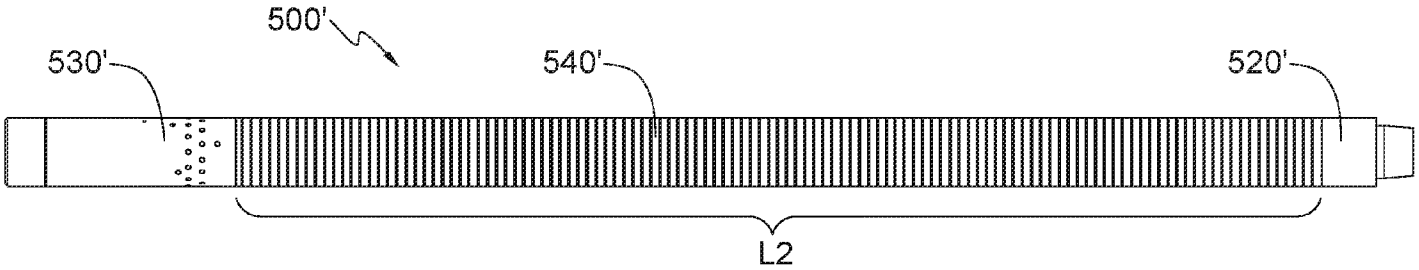
FIGS. 21A and 21B are side and cross-sectional views, respectively, of an example gap sub with a very long gap.
Figure 21B:
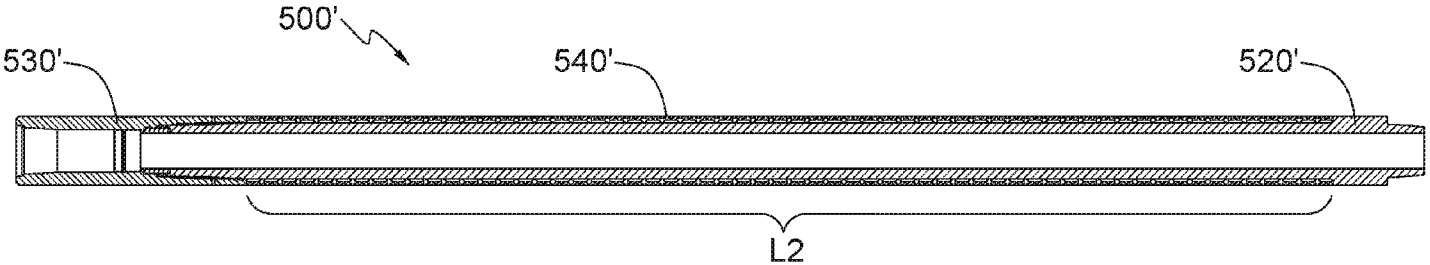

FIGS. 21A and 21B are side and cross-sectional views, respectively, of an example gap sub 500', similar in design to gap sub 500. An insulating collar 540' is located between a male member 520' and a female member 530'. Insulating collar 540' has length L2, which is greater than L1. The resistance experienced by electrical current flowing from male member 520' to female member 530' through drilling fluid (not shown) is R2, which is greater than R1.

The relationship between L1, L2, R1, and R2 is roughly L1/L2=R1/R2. In other words, the resistance through the drilling fluid between the male and female members is roughly proportional the length of the insulating collar. This proportionality may break down for extremely long gap lengths, there may, for example, be diminishing returns for gaps longer than about 30 feet.

The length of a collar may be selected depending on the nature of the drilling operation. A longer collar increases the electrical resistance between antenna elements, and therefore permits stronger EM signals to be generated while using less electric power. Where the output of an EM telemetry system is current limited, for a given output current the voltage between the antenna elements may be higher. Also, for a given voltage difference between the antenna elements the current will be smaller. These are evident from Ohm's law: V=IR. A higher voltage between the antenna elements produces a stronger EM signal. The voltage received at the surface is generally proportional to the voltage between the downhole antenna elements.

Figure 22:
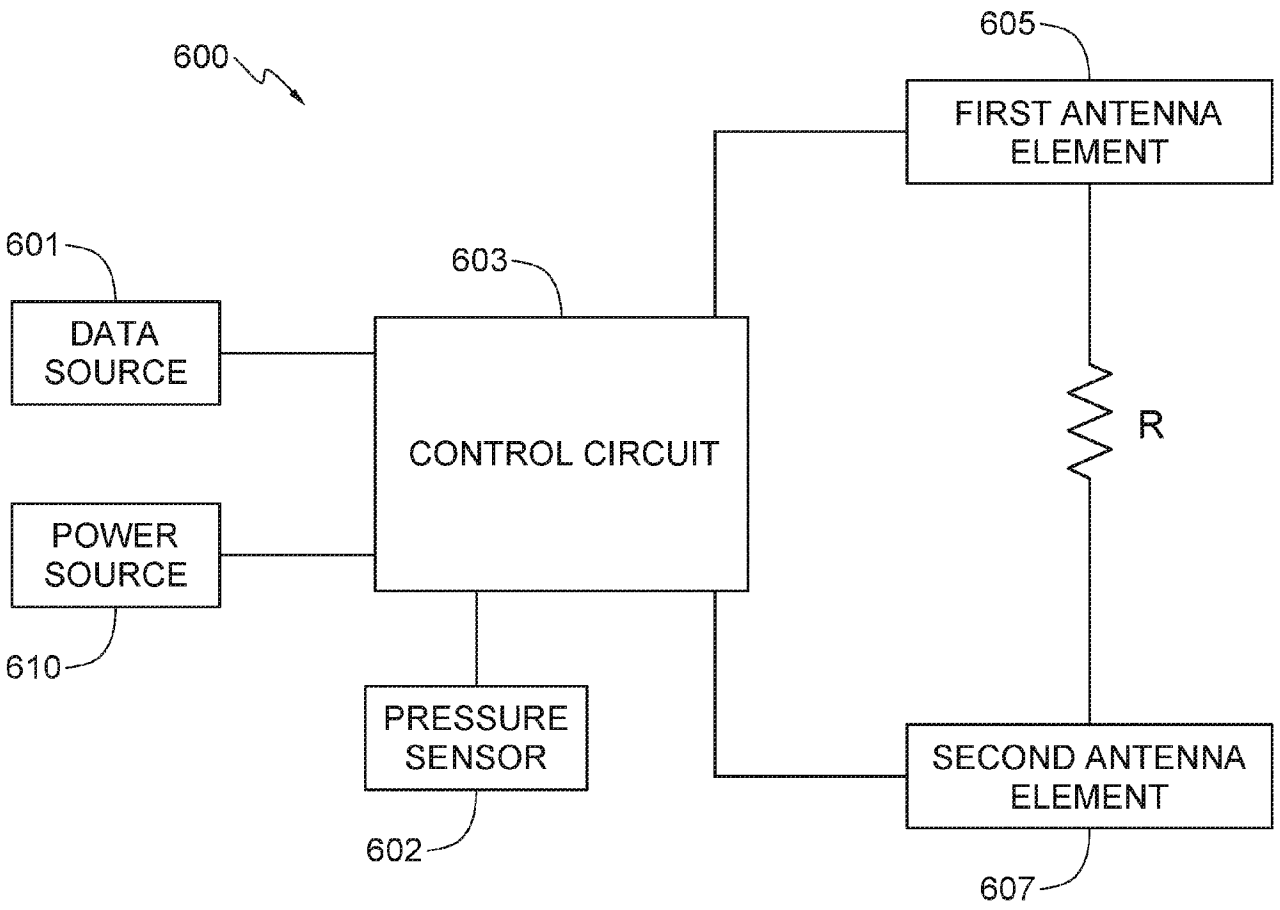
FIG. 22 is a schematic view of an example electromagnetic telemetry system.

FIG. 22 shows schematically an example EM telemetry system 600. A data source 601 provides data to a control circuit 603. The data from data source 601 may comprise data obtained by a downhole sensor, for example. Control circuit 603 provides a variable voltage between a first antenna element 605 and a second antenna element 607 to generate an EM signal which encodes the data. Any suitable encoding scheme may be used. Control circuit 603 is powered by a power source 610. Power source 610 may comprise any suitable means of power storage (e.g. a battery) or generation (e.g. a mud motor, mud turbine, or the like connected to drive an electric generator).

First and second antenna elements 605, 607 may comprise sections of drill string electrically separated from one another by the gap of a gap sub. Current may pass between the antenna elements through drilling fluid and geological formations surrounding the gap sub. The effective resistance encountered by current passing through this drilling fluid is R. The gap sub may be very long, (e.g. equal to or longer than 12 inches (30 cm)), causing R to be very high.

When control circuit 603 drives a voltage, V, across first antenna element 605 and second antenna element 607, some current, I, will flow through the drilling fluid and geological formations between the antenna elements and this current will experience resistance R. An amount of power equal to approximately (V^2)/R will be dissipated as waste heat. Thus for any given voltage of applied EM telemetry signals, a higher value of R will reduce amount of lost power.

A higher value of R allows for a given voltage differential between first antenna element 605 and second antenna element 607 to be maintained with relatively minimal lost power. Efficient use of downhole power sources is important because of the difficulties in storing and/or generating power downhole.

A higher value of R also allows for relatively higher voltage differentials between antenna elements 605, 607 without incurring excessive power losses due to current flowing through the drilling fluid. The high value of R also allows for relatively higher voltage differentials to be maintained between antenna elements 605 and 607 for a given current capacity of control circuit 603, and thus relatively stronger EM signals. Higher voltage differentials generate stronger EM signals, which are easier to detect at the surface. Such signals may allow for use of EM telemetry even in situations where EM signals are highly attenuated as they travel to the surface (e.g. very deep wells, or wells passing through high salt formations or formations of high resistivity contrast).

Control circuit 603 may include circuits configured modify the voltage output of power source 610 so as to provide EM telemetry signals. For example, control circuit 603 may include a switched mode power supply, a voltage multiplier, an inverter, transformer, and rectifier or other suitable circuits for stepping up the voltage of power source 610 to a higher voltage. In some embodiment control circuit 603 is configured to double or more than double a voltage output by a battery pack prior to applying the voltage across the gap in a gap sub.

In conventional gaps, voltages of about 12 to 14 volts and currents of about 3-5 Amperes are typically used. When water-based drilling fluid is used, conventional gaps may be driven with a voltage of less than 10 volts. Long gaps as described herein may be used with higher voltages of, for example, at least 18, 36, 100, or 500 volts. High voltage circuitry may be used to accommodate these voltages. In some embodiments a current of less than 10 or 6 Amperes may be used.

The voltage may be provided by any suitable source, such as a battery or a downhole power generating apparatus (e.g. a drilling fluid powered turbine). In some embodiments, a maximum voltage may be set. The maximum voltage may be, selected based on safety considerations. For example. In some embodiments the maximum voltage is less than 50 volts.

Control circuit 603 may be configured to adjust the voltage driven between the antenna elements depending on the voltage needed to generate EM signals that can be detected at the surface. For example, control circuit 603 may be configured to increase the voltage as the well bore becomes deeper. Control circuit 603 may be connected to receive a signal from a downhole pressure sensor 602. Pressure sensor 602 may measure the depth of the well bore indirectly by measuring the pressure of the drilling fluid and may adjust the EM telemetry signal voltage based on the measured pressure. In other embodiments, control circuit 603 is configured to set the voltage of uplink telemetry signals in response to instructions received by downlink telemetry from the surface. The downlink telemetry may comprise electromagnetic telemetry, mud pulse telemetry, drill string acoustic telemetry, telemetry by operating the drill string in particular patterns, or any other mode of telemetry.

Control circuit 603 may be configured to measure the value of the resistance between the antenna elements. Control circuit 603 may make this measurement by applying a known voltage between the antenna elements, and then measuring the current that flows as that voltage is maintained. Control circuit 603 may adjust the voltage that is driven between the antenna elements based on this measured resistance. For example, control circuit may reduce power losses by applying a relatively low voltage when the measured resistance is relatively low.

Control circuit 603 may drive a variable voltage between the antenna elements to produce a wide variety of different types of EM signals which encode data in a wide variety of different ways. In some embodiments, control circuit 603 controls a switching circuit such as an H-bridge that enables control over whether or not an electrical potential difference is applied between first antenna element 605 and second antenna element 607 and the polarity of an applied potential difference. In some embodiments control circuit 603 is configured to control the switching circuit to encode data by varying a frequency with which the polarity of an applied potential difference is reversed. For example, in a very simple encoding scheme a first frequency is associated with a logical "1" and a second frequency is associated with a logical "0".

In some embodiments, control circuit 603 is also configured to select a magnitude of potential difference to apply between first antenna element 605 and second antenna element 607. Data may be encoded by varying the magnitude of the potential difference. In some embodiments, two data streams may be encoded simultaneously and/or a higher telemetry data rate may be achieved by varying both the frequency of the reversal of the potential difference and the magnitude of the potential difference.

In some embodiments, control circuit 603 is configured to vary the magnitude of potential difference between the first antenna element 605 and second antenna element 607 continuously (as opposed to discretely). Data may be encoded in the pattern with which the magnitude varies. For example, data may be encoded in the frequency domain or the time domain of the varying magnitude.

The internal diameters of the bores in some gap subs may be smaller than those of other drill string components. For example, the wall thickness of a gap sub may be increased relative to other drill string components to provide enhanced resistance of the gap sub to bending. Mounting a downhole probe within the bore of such gap subs may leave only a relatively small space for drilling fluid to flow around the probe. This may be undesirable for several reasons, including:

- the maximum flow rate of drilling fluid may be constrained;
- the flow velocity of drilling fluid in the gap sub may be excessively high, resulting excessive wear of the probe and the gap sub due to cavitation; and
- solid particles carried by the drilling fluid may become lodged in the space between the probe and the gap sub.

Figure 23:
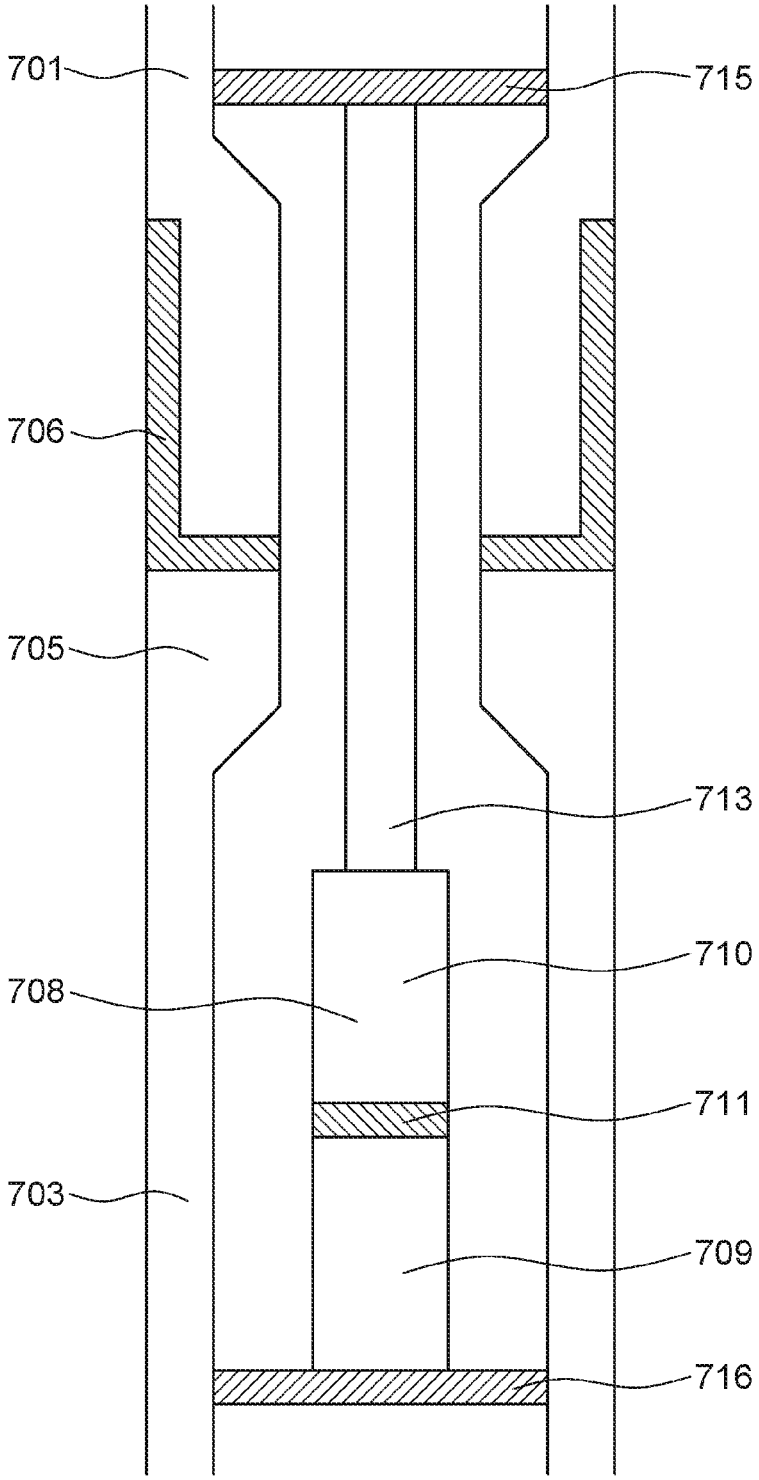
FIG. 23 is a cross-sectional view of an example gap sub and downhole probe combination.

FIG. 23 is a schematic cross-sectional view of an upper section of drill string 701, a lower section of drill string 703, a gap sub 705 with an insulating gap 706, and a probe 708 with an insulating gap 709. Internal details of gap sub 705 are omitted for clarity. Upper section 701 and lower section 703 each have larger internal diameters than gap sub 705.

Probe 708 is mounted in lower section 703. Probe 708 has a lower end 709 and an upper end 710. Lower end 709 is electrically insulated from upper end 710 by an insulating gap 711. Lower end 709 of probe 708 is mounted to lower section 703 by a lower spider 716. Upper end 710 of probe 708 comprises or is mounted to a rod 713. Probe 708 may be mounted to rod 713 by a coupling, such as a threaded coupling, a pinned coupling, or the like. Probe 708 may be integrally formed with rod 713. Rod 713 may have different lengths. The same probe 708 may be used with different rods 713 of different lengths depending on the requirements of a particular drilling operation, including the required gap length.

Rod 713 is narrower than probe 708. In the illustrated embodiment, rod 713 passes all the way through gap sub 705 to upper section 701, and is mounted by an upper spider 715 to upper section 701. In some embodiments, rod 713 does not pass all the way through gap sub 705, and is mounted by upper spider 715 to a portion of gap sub 705 that is electrically connected to upper section 701.

In some embodiments, there is no lower spider 716 and probe 708 is supported solely by upper spider 715 and rod 713. In these embodiments, lower end 709 of probe 708 may be electrically connected to lower section 703 by some means other than lower spider 716.

The use of rod 713 to maintain an electrical connection across the gap in gap sub 705 while allowing probe 708 to be supported in a part of the bore of the drill string away from the narrowed bore within gap sub 705 results in a larger cross sectional flow area within gap sub 705 and a larger cross sectional flow area around probe 708. This may permit a relatively higher flow rate of drilling fluid through gap sub 705 at a relatively lower flow velocity. The use of rod 713 may also permit the use of a gap sub with a relatively narrow internal diameter (thicker walls) while still having an acceptable cross sectional flow area. A gap sub with a relatively narrow internal diameter may be relatively stronger and more durable.

Lower end 709 of probe 708 is electrically connected to lower section 703 via lower spider 716. Upper end 710 of probe 708 is electrically connected to upper section 701 via rod 713 and upper spider 715. Probe 708 can drive a voltage between lower section 703 and upper section 701 so that they act as the elements of a dipole antenna.

In some embodiments, probe 708 may be mounted in upper section 701 and rod 713 is mounted to a lower end of probe 708. In some embodiments, a centralizer keeps rod 713 positioned in the center of gap sub 705. In some embodiments, the centralizer is electrically insulated so that it does not provide a low impedance path between upper and lower parts of gap sub 705.

Figure 24:
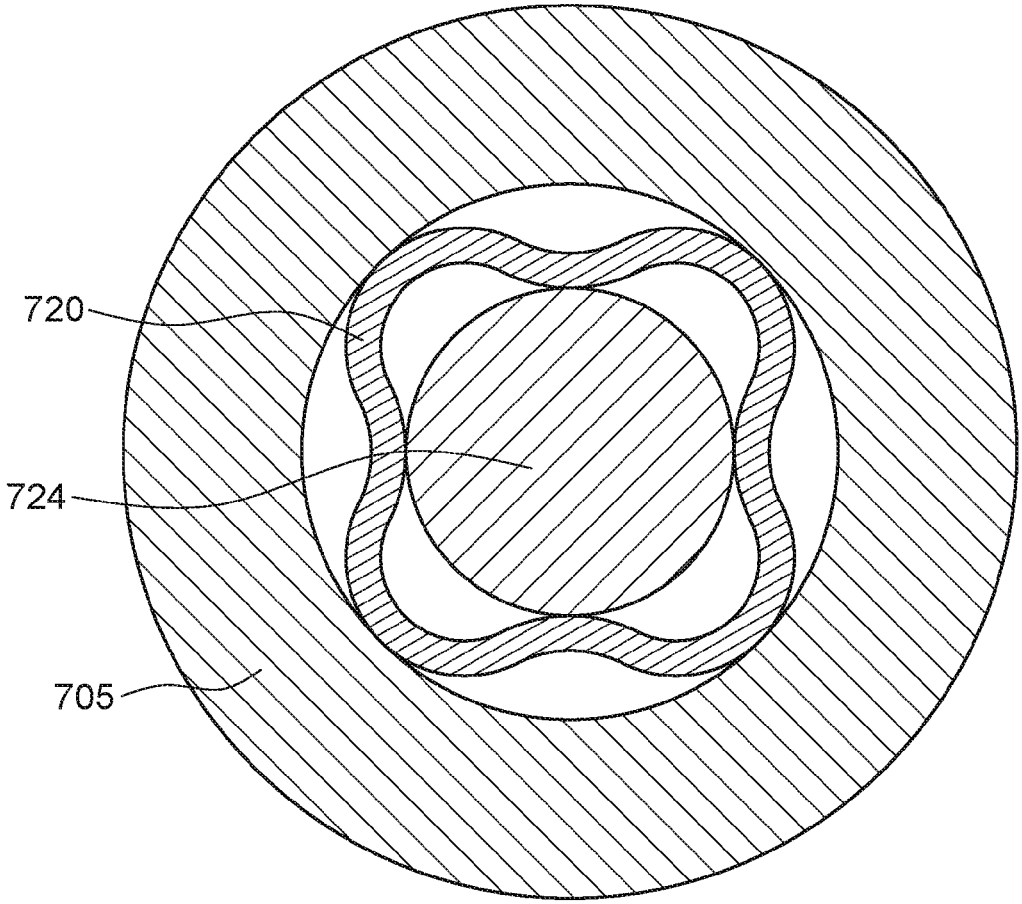
FIG. 24 is a cross-sectional view of a rod, a gap sub, and an example centralizer.

FIG. 24 is a cross sectional view of rod 713 positioned in the centre of gap sub 705 by a centralizer 720. Centralizer 720 comprises an elongated tubular member having a wall formed to provide a cross-section that provides outwardly-convex and inwardly-concave lobes. The lobes are arranged to contact the inner wall of gap sub 705. Centralizer 720 also comprises a plurality of inwardly-projecting projections. The projections are arranged to contact rod 713 and thereby support it in the centre of gap sub 705. In other embodiments, centralizer may have other designs.

In some embodiments, probe 708 is mounted above or below gap sub 705 without the use of rod 713. In such embodiments, probe 708 may be mounted such that lower end 709 is electrically connected to lower section 703 and upper end 710 is electrically connected to upper section 701.

Figure 25B:
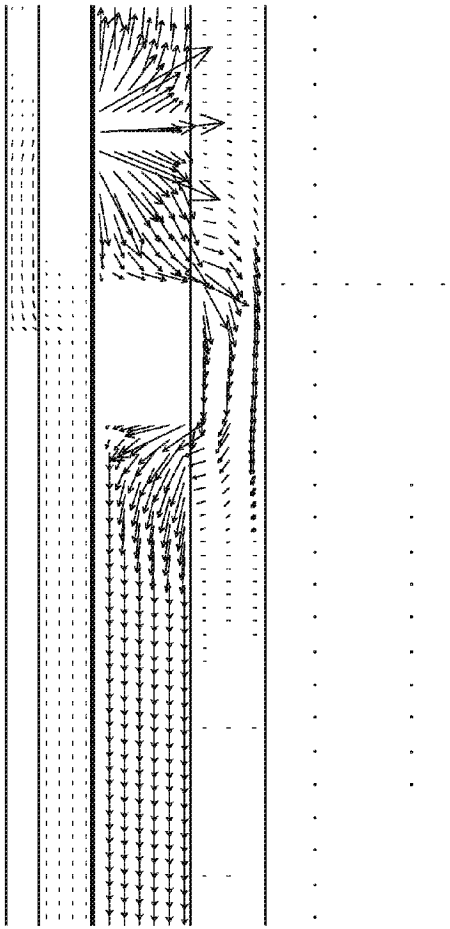
FIG. 25B is a vector field diagram of electric currents in the apparatus of FIG. 25A.
Figure 25A:
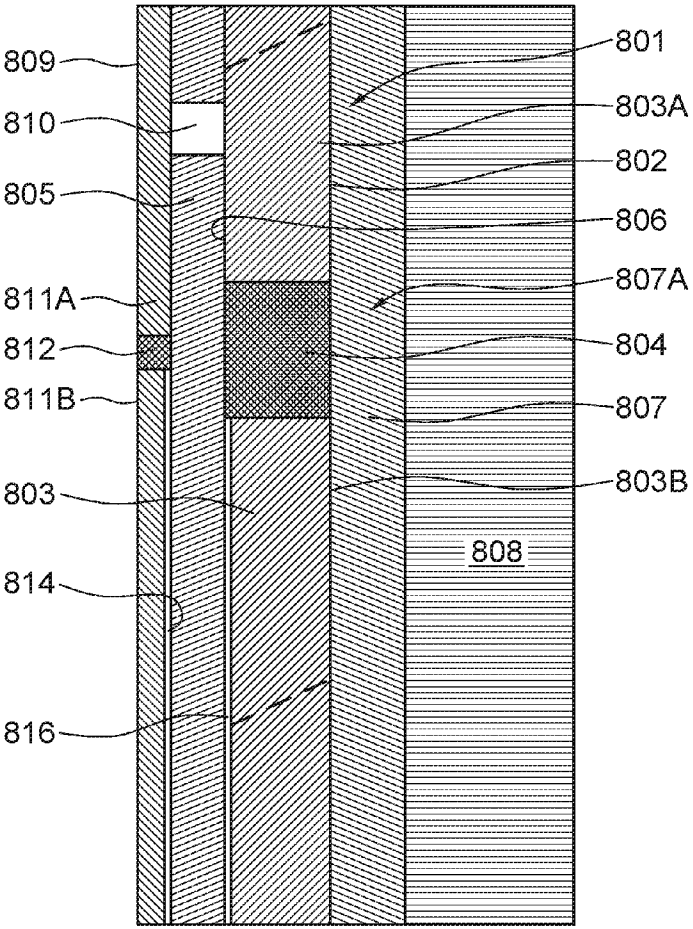
FIG. 25A is a schematic, cross-sectional view of an example gap sub and downhole probe combination.

FIG. 25A is a schematic, cross-sectional view of an example gap sub and downhole probe combination. For clarity, only one half of the wellbore (and the apparatus therein) is shown. A section of drill string 801 includes a gap sub 802. Gap sub 802 comprises an uphole part 803A and a downhole part 803B separated by an electrically-insulating gap 804.

Interior drilling fluid 805 flows downhole through a bore 806 of section 801. Exterior drilling fluid 807 flows uphole through an annular area 807A between section 801 and the formation 808 surrounding the wellbore. A probe 809 is mounted within bore 806 by a spider 810. Probe 809 has a housing comprising first and second electrically-conducting parts 811A and 811B separated by an electrically-insulating gap 812.

A first insulating sleeve 814 covers a portion of probe 809 adjacent to insulating gap 812. A second insulating sleeve 816 covers a portion of the interior wall of drill string 801 adjacent to gap 804.

EM telemetry signals may be transmitted by applying an alternating potential difference between uphole part 803A and downhole part 803B. This potential difference may be generated and applied by a telemetry signal generator included in probe 809, for example. It is desired that EM signals so generated will result in a signal that can be detected at the surface by monitoring potential differences between the drill string and one or more ground references. To achieve this, electric fields of the telemetry signals should penetrate the surrounding formations 808. Conduction of electric current directly between parts 803A and 803B either through drilling fluid 805 in bore 806 or drilling fluid 807 in area 807A tends to reduce the penetration of electric fields into the surrounding formations 808. First insulating sleeve 814 and second insulating sleeve 816 (both of which are optional) increase the impedance of paths between parts 803A and 803B through drilling fluid 805 in bore 806.

FIG. 25B is a vector field diagram corresponding to the model of FIG. 25A in which different materials are indicated by different textures. The model assigns different electrical conductivities to the different materials. Parts 803A and 803B, and housing parts 811A and 811B and spider 810 are modelled as having a first electrical conductivity, $\kappa_1$, drilling fluid 805 and 807 is modelled as having a second electrical conductivity, $\kappa_2$, formation 808 is modelled as having a third electrical conductivity, $\kappa_3$, and gaps 804 and 812 and sleeves 814 and 816 are modelled as having a fourth electrical conductivity, $\kappa_4$, with $\kappa_1>\kappa_2>\kappa_3>\kappa_4$. In some versions of the model, $\kappa_1$ is taken to be the conductivity of metal, $\kappa_2$ is taken to be the conductivity of water, $\kappa_3$ is taken to be the mean conductivity of earth, and $\kappa_4$ is taken to be the conductivity of plastic.

The vector field diagram in FIG. 25B shows the direction and magnitude of electric currents predicted by the model. Making gap 812 long relative to the radial thickness of annular region 807A tends to result in electric fields extending parallel to the surface of formation 808 over an elongated section of the wellbore. This helps to enhance penetration of electric fields into formation 808 for detection at the surface.

Figure 26B:
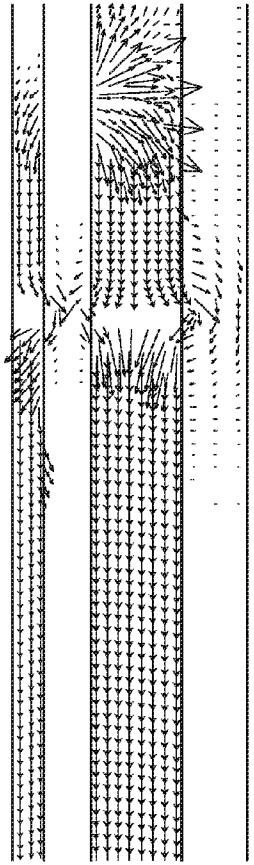
FIG. 26B is a vector field diagram of electric currents in the apparatus of FIG. 26A.
Figure 26A:
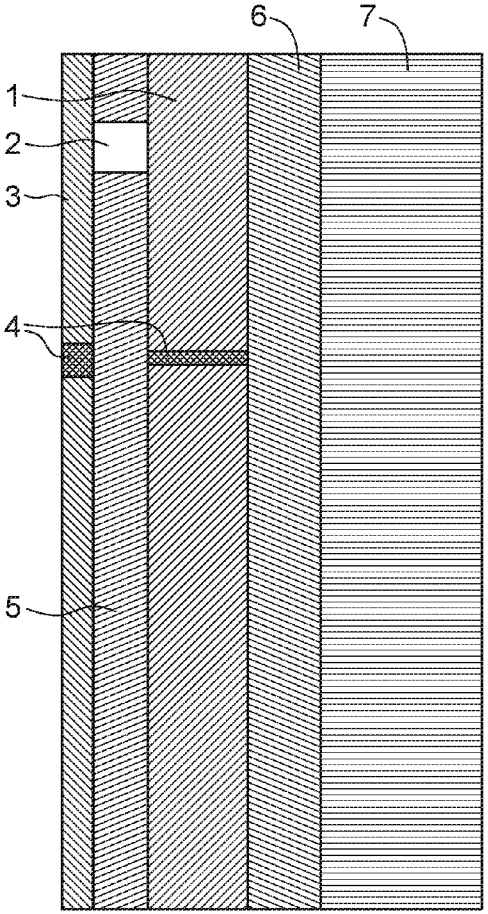
FIG. 26A is a schematic, cross-sectional view of a contrasting example gap sub and downhole probe combination.

FIGS. 25A and 25B can be contrasted with FIGS. 26A and 26B which are the same as FIGS. 25A and 25B except that they show a situation where a conventional short gap is provided. It can be seen that the electrical current paths (which correspond to electrical field direction) have substantial curvature. Also, even a very small region of low resistance at the gap can cause relatively high currents even at lower voltages. Especially in the presence of water-based drilling fluids the voltage/current provided to a conventional gap as illustrated in FIGS. 26A and 26B is typically limited to less than 10 Volts and less than 6 Amperes.

Figure 27:
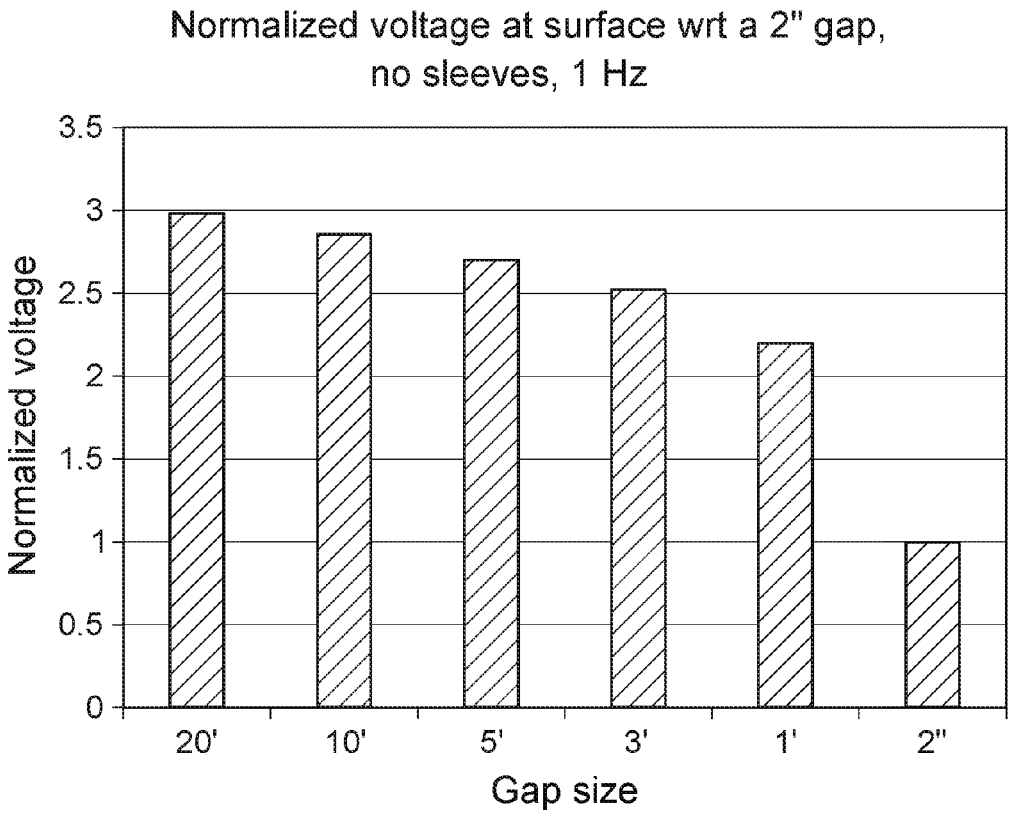
FIG. 27 is a chart showing normalized voltages detected at the surface from a 1 HZ EM telemetry signal generated by example EM telemetry systems.

FIG. 27 is a chart showing the results of a mathematical model. The chart shows the normalized voltage detected at the surface from a 1 HZ EM telemetry signal generated by downhole EM telemetry systems with no insulating sleeves and with a variety of different gap sizes. For all gap sizes, the EM telemetry system is powered with a current of 1 amp. The voltage detected at the surface is normalized to '1' for a 2 inch gap. With a 1 foot gap, the normalized voltage is approximately 2.25 times as large as with a 2 inch gap. It can be seen that the normalized voltage continues to increase (but at a rate that slows) for increases in gap size up to 20 feet. FIG. 27 shows that for a gap size of 20 feet the signal received at the surface is three times larger than in the case where the gap used is 2 inches.

An extended gap provides particular benefits in the case where the gap sub has a large diameter and/or the wellbore has a large diameter and/or the drilling fluid being used has a higher electrical conductivity (e.g. where the drilling fluid is a water-based fluid having a high electrical conductivity in comparison to oil-based drilling fluids). In some embodiments the gap length equals or exceeds the circumference of the outside diameter of the gap sub. In some embodiments, the gap has a length which is a multiple of the gap sub diameter (e.g. A times the gap sub diameter where A>1, for example, A may be 1½, 2, 5, 10, or more). In some embodiments the gap length equals or exceeds the borehole diameter. In some embodiments the gap length is a multiple of the borehole diameter (e.g. B times the borehole diameter where B>1, for example B may be 1½, 2, 5, 10, or more). In some embodiments the gap has a length that is greater than the span of a typical person's arms (e.g. greater than 6 feet (180 cm)). Such embodiments are advantageous for reducing the possibility that a person would simultaneously touch the drill string on both sides of the gap, thereby receiving an electric shock.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those of skill in the art. The invention in its broader aspects is therefore not limited to the specific details, representative apparatus and methods, and illustrative examples shown and described.

Certain modifications, permutations, additions and sub-combinations thereof are inventive and useful and are part of the invention. It is therefore intended that the following appended claims and claims hereafter introduced are interpreted to include all such modifications, permutations, additions and sub-combinations as are within their true spirit and scope.

INTERPRETATION OF TERMS

Unless the context clearly requires otherwise, throughout the description and the

- "comprise," "comprising," and the like are to be construed in an inclusive sense, as opposed to an exclusive or exhaustive sense; that is to say, in the sense of "including, but not limited to".
- "connected," "coupled," or any variant thereof, means any connection or coupling, either direct or indirect, between two or more elements; the coupling or connection between the elements can be physical, logical, or a combination thereof.
- "herein," "above," "below," and words of similar import, when used to describe this specification shall refer to this specification as a whole and not to any particular portions of this specification.
- "or," in reference to a list of two or more items, covers all of the following interpretations of the word: any of the items in the list, all of the items in the list, and any combination of the items in the list.

the singular forms "a," "an," and "the" also include the meaning of any appropriate plural forms.

Words that indicate directions such as "vertical," "transverse," "horizontal," "upward," "downward," "forward," "backward," "inward," "outward," "vertical," "transverse," "left," "right," "front," "back", "top," "bottom," "below," "above," "under," and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g., an assembly, ring, body, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

The invention claimed is:

1. An apparatus useful for drilling, the apparatus comprising a probe; a section of drill string; a gap sub in the section of drill string; and a rod;

wherein:

the rod is connected to support the probe;

the rod passes through at least a portion of a bore in the gap sub; and a diameter of the rod is less than a diameter of the probe.

2. The apparatus according to claim 1 wherein the rod passes all the way through the bore in the gap sub.

3. The apparatus according to claim 2 wherein the bore of the gap sub has a diameter smaller than an internal diameter of the section of drill string.

4. The apparatus according to claim 3 wherein an uphole end of the rod away from the probe is connected to an upper spider and the upper spider is supported by an upper portion of the section of drill string above the gap sub.

5. The apparatus according to claim 3 wherein the probe comprises a first end connected to the rod, a second end, and an insulating gap electrically insulating the first end from the second end.

6. The apparatus according to claim 4 wherein the second end of the probe is electrically connected to a lower portion of the section of drill string below the gap sub.

7. The apparatus according to claim 6 wherein the second end of the probe is connected to a lower spider, and the lower spider is supported by the lower portion of the section of drill string below the gap sub.

8. The apparatus according to claim 6 wherein a wall of the gap sub has a thickness larger than a wall thickness of the upper portion and the lower portion of the section of drill string.

9. The apparatus according to claim 1 wherein the probe is connected to a first spider, the first spider is connected to the section of drill string, the rod is connected to a second spider, and the second spider is connected to the gap sub.

10. The apparatus according to claim 1 wherein an external diameter of the rod is less than an external diameter of the probe.

11. The apparatus according to claim 1 comprising an elongated tubular centralizer wherein the rod passes through the centralizer.

12. The apparatus according to claim 11 wherein the centralizer has a wall formed to provide a cross-section that provides outwardly-convex and inwardly-concave lobes and inwardly-facing projections, the lobes contacting a wall of the bore of the gap sub and the projections contacting the rod.

13. The apparatus according to claim 12 wherein the centralizer is electrically insulating.

14. The apparatus according to claim 1 wherein the rod is detachable from the probe.

15. The apparatus according to claim 1 wherein the gap sub comprises an electrically insulating gap and the gap has a length measured along the gap sub that exceeds an outer diameter of the gap sub.

16. An apparatus useful for drilling, the apparatus comprising:

a gap sub coupled between a tubular uphole drill string section and a tubular downhole drill string section, the gap sub electrically insulating the uphole drill string section from the downhole drill string section, the gap sub comprising a bore providing fluid communication between bores of the uphole drill string section and the downhole drill string section, at least a portion of the bore of the gap sub being a smaller-diameter section wherein, in the smaller-diameter section the bore of the gap sub has a cross sectional area smaller than cross sectional areas of the bores of the uphole and downhole drill string sections;

a probe supported in the bore of the lower drill string section by a rod extending from an uphole end of the probe through the smaller-diameter section of the bore of the gap sub to a support above the smaller-diameter section of the bore of the gap sub, the rod having a cross sectional area smaller than that of the probe.

17. The apparatus according to claim 16 wherein the rod extends through a centralizer, the centralizer contacting the rod and a wall of the bore of the gap sub and providing passages for flow of fluid through the smaller-diameter section of the bore of the gap sub.

18. The apparatus according to claim 17 wherein the centralizer has a wall formed to provide a cross-section that provides outwardly-convex and inwardly-concave lobes and inwardly-facing projections, the lobes contacting a wall of the bore of the gap sub and the projections contacting the rod.

19. The apparatus according to claim 18 wherein a downhole end of the probe is held by a support supported by the downhole drill string section.

20. The apparatus according to claim 19 wherein the downhole end of the probe is electrically insulated from the rod, the rod is electrically connected to the uphole drill string section, the downhole end of the probe is electrically connected to the downhole drill string section and the probe comprises an electromagnetic telemetry transmitter having first and second outputs, the first output electrically connected to the uphole drill string section by way of the rod and the second output electrically connected to the downhole drill string section.

* * * * *